US010952580B1

(12) United States Patent
Kim

(10) Patent No.: US 10,952,580 B1
(45) Date of Patent: Mar. 23, 2021

(54) CLEANING DEVICE WITH ROTATABLE HEAD

(71) Applicant: SharkNinja Operating LLC, Needham, MA (US)

(72) Inventor: Yu Ri Young Kim, Brighton, MA (US)

(73) Assignee: SHARKNINJA OPERATING LLC, Needham, MA (US)

( * ) Notice: Subject to any disclaimer, the term of this patent is extended or adjusted under 35 U.S.C. 154(b) by 0 days.

(21) Appl. No.: 16/795,238

(22) Filed: Feb. 19, 2020

(51) Int. Cl.

| | |
|---|---|
| ***A47L 9/04*** | (2006.01) |
| ***A47L 9/32*** | (2006.01) |
| ***A47L 9/06*** | (2006.01) |
| *A47L 13/22* | (2006.01) |
| *A47L 13/40* | (2006.01) |

(52) U.S. Cl.
CPC ..... *A47L 9/0606* (2013.01); *A47L 9/32* (2013.01); *A47L 13/22* (2013.01); *A47L 13/40* (2013.01)

(58) Field of Classification Search
CPC ..... A47L 9/04; A47L 13/22; A47L 13/40
See application file for complete search history.

(56) References Cited

U.S. PATENT DOCUMENTS

| | | | |
|---|---|---|---|
| 490,472 | A | 1/1893 | Clements |
| D117,388 | S | 10/1939 | Woinarovicz |
| D214,977 | S | 8/1969 | Roth |
| D247,949 | S | 5/1978 | Tillinghast et al. |
| D250,245 | S | 11/1978 | Bebb |
| D278,099 | S | 3/1985 | Evans |
| 5,365,881 | A | 11/1994 | Sporn |
| 5,664,285 | A | 9/1997 | Melito et al. |
| 5,829,090 | A | 11/1998 | Melito et al. |
| D423,157 | S | 4/2000 | Hodges |
| 6,102,278 | A | 8/2000 | Rothas |
| 6,453,506 | B1 | 9/2002 | Summer |
| 6,571,421 | B1 | 6/2003 | Sham et al. |
| 6,966,098 | B2 | 11/2005 | Sako et al. |
| 7,013,528 | B2 | 3/2006 | Parker et al. |

(Continued)

FOREIGN PATENT DOCUMENTS

| | | | |
|---|---|---|---|
| CN | 103356140 | A | 10/2013 |
| CN | 205181229 | U | 4/2016 |

(Continued)

OTHER PUBLICATIONS

Amazon.com—Shark Genius Steam Pocket Mop Hard Floor Cleaner, oldest reviews 2016, https://www.amazon.com/Cleaner-Blaster-Technology-Intelligent-S5003D/dp/B01 KU4BSGK/ref=cm_cr arp_d_product_top?ie=UTF8, site visited Oct. 11, 2018.

(Continued)

*Primary Examiner* — Michael D Jennings
(74) *Attorney, Agent, or Firm* — Dilworth IP, LLC

(57) ABSTRACT

A cleaning device including a handle assembly including a proximal end and a distal end, a base having a front edge and a rear edge, a hinge attached between the distal end of the handle assembly and the base, the hinge defining a first axis between the hinge and the base, a replacement head removably attachable to the base, the replacement head including a suction inlet and a pad defining a lower surface, wherein the first axis is positioned to maintain contact between the lower surface and a floor and avoid skipping.

25 Claims, 25 Drawing Sheets

(56) References Cited

U.S. PATENT DOCUMENTS

| | | | |
|---|---|---|---|
| 7,048,804 | B2 | 5/2006 | Kisela et al. |
| 7,137,169 | B2 | 11/2006 | Murphy et al. |
| 7,150,069 | B2 | 12/2006 | Hori et al. |
| D548,907 | S | 8/2007 | Killen |
| 7,293,322 | B2 | 11/2007 | Matousek et al. |
| 7,329,294 | B2 | 2/2008 | Conrad |
| 7,337,494 | B2 | 3/2008 | Baer et al. |
| 7,409,745 | B2 | 8/2008 | Dodson et al. |
| D597,717 | S | 8/2009 | Rosenzweig et al. |
| 7,673,361 | B2 | 3/2010 | Policicchio et al. |
| 7,676,877 | B2 | 3/2010 | Policicchio et al. |
| 7,861,351 | B2 | 1/2011 | Ho |
| 7,934,287 | B2 | 5/2011 | De Soto-Burt et al. |
| 8,020,236 | B2 | 9/2011 | Kaleta et al. |
| 8,065,778 | B2 | 11/2011 | Kim et al. |
| D661,034 | S | 5/2012 | Ediger et al. |
| D672,107 | S | 12/2012 | Van Landingham, Jr. et al. |
| 8,341,802 | B2 | 1/2013 | Kim et al. |
| 8,458,850 | B2 | 6/2013 | Kasper et al. |
| 8,495,781 | B2 | 7/2013 | Dingert |
| D703,407 | S | 4/2014 | Xiong |
| D731,137 | S | 6/2015 | Colangelo |
| D764,127 | S | 8/2016 | Vicari et al. |
| D766,584 | S | 9/2016 | Blouin et al. |
| 9,504,366 | B2 | 11/2016 | Kasper et al. |
| 9,661,968 | B2 | 5/2017 | Bradbury |
| D804,123 | S | 11/2017 | Orsino |
| 9,901,231 | B2 | 2/2018 | Tibberts |
| D817,574 | S | 5/2018 | Libman et al. |
| 2003/0159230 | A1 | 8/2003 | Oh |
| 2004/0045126 | A1 | 3/2004 | Parker et al. |
| 2004/0134016 | A1 | 7/2004 | Kisela et al. |
| 2004/0134025 | A1 | 7/2004 | Murphy et al. |
| 2004/0141798 | A1 | 7/2004 | Garabedian, Jr. et al. |
| 2005/0115409 | A1 | 6/2005 | Conrad |
| 2005/0193516 | A1 | 9/2005 | Hughes |
| 2007/0245511 | A1 | 10/2007 | Hahm et al. |
| 2010/0024156 | A1 | 2/2010 | De Soto-Burt et al. |
| 2010/0024157 | A1* | 2/2010 | Vernon ..... A47L 9/0686 15/403 |
| 2010/0115719 | A1 | 5/2010 | West et al. |
| 2012/0311813 | A1 | 12/2012 | Gilbert, Jr. et al. |
| 2013/0055521 | A1* | 3/2013 | Lee ..... A47L 11/4025 15/319 |
| 2014/0033470 | A1 | 2/2014 | Codling |
| 2014/0033471 | A1 | 2/2014 | Toole et al. |
| 2016/0174793 | A1 | 6/2016 | Burke et al. |
| 2017/0007086 | A1 | 1/2017 | Kleine-Doepke et al. |
| 2017/0202421 | A1 | 7/2017 | Hwang et al. |
| 2018/0035855 | A1 | 2/2018 | Wood |
| 2018/0055315 | A1 | 3/2018 | Conrad |
| 2018/0177367 | A1 | 6/2018 | Amaral et al. |
| 2018/0220861 | A1 | 8/2018 | Zhang et al. |
| 2019/0075984 | A1 | 3/2019 | James et al. |
| 2019/0274496 | A1 | 9/2019 | James et al. |
| 2019/0274497 | A1 | 9/2019 | James et al. |
| 2019/0274498 | A1 | 9/2019 | James et al. |
| 2019/0282045 | A1 | 9/2019 | James et al. |

FOREIGN PATENT DOCUMENTS

| | | | |
|---|---|---|---|
| EP | 1027844 | A2 | 8/2000 |
| JP | 2006198083 | A | 8/2006 |
| JP | D1489801 | S | 2/2014 |
| KR | 20170043227 | A | 4/2017 |
| WO | 2004062454 | A2 | 7/2004 |
| WO | 2004062457 | A2 | 7/2004 |
| WO | 2005018402 | A2 | 3/2005 |
| WO | 2010014366 | A1 | 2/2010 |
| WO | 2010014367 | A1 | 2/2010 |
| WO | 2011017493 | A1 | 2/2011 |
| WO | 2011112545 | A2 | 9/2011 |
| WO | 2014020303 | A1 | 2/2014 |
| WO | 2014104503 | A1 | 7/2014 |
| WO | 2016022270 | A1 | 2/2016 |
| WO | 2016062647 | A1 | 4/2016 |
| WO | 2016095040 | A1 | 6/2016 |
| WO | 2016100964 | A2 | 6/2016 |
| WO | 2019051431 | A1 | 3/2019 |

OTHER PUBLICATIONS

International Search Report; Application No. PCT/US2018/050308; dated Nov. 26, 2018; 3 pages.

* cited by examiner

CLEANING DEVICE WITH ROTATABLE HEAD

FIELD OF THE INVENTION

The present disclosure relates generally to cleaning devices, and more specifically to a cleaning device having a rotatable base with a replacement head.

BACKGROUND

Hard floor cleaning can be challenging when there are a variety of mixed media debris present. In some instances, there is a desire to both vacuum dry, loose debris, scrub stuck debris, and absorb any wet debris that may be present. Prior art tools, such as vacuums, dry mops and wet mops are capable of handling some of these types of media, but not all at once. As a result, many often sweep dry debris before mopping wet or stuck-on debris.

Known tools that can handle both dry and wet media have higher set-up times than a broom/mop combination and the after-use maintenance can be especially high when liquids are involved. If the combination tool is not properly cleaned after each use, they can become smelly and unpleasant. Lastly, clean up can be quite messy and the user may be required to either dirty his or her hands and/or wear gloves.

Therefore, an improved hard floor cleaner that can be easily attached and detached to a cleaning device with minimal effort and mess is desired.

SUMMARY OF THE INVENTION

According to one aspect of the invention, the cleaning device includes a handle assembly including a proximal end and a distal end, a base having a front edge and a rear edge, a hinge rotatably attaching the distal end of the handle assembly and the base, the hinge defining a first axis between the hinge and the base, a replacement head removably attachable to the base, the replacement head including a suction inlet and a pad defining a lower surface of the cleaning device. In some embodiments, the first axis is at or below a height that is equal to half of the width, such as less than 60 mm above the lower surface, or such as 30-40 mm above the lower surface.

In some embodiments, the handle assembly is pivotable about the first axis in fore and aft directions with respect to the base, and the handle assembly is pivotable in left and right directions about a second axis defined by the hinge between the hinge and the distal end of the handle assembly. In some embodiments, the first axis is between 30 mm and 40 mm above the lower surface and/or the first pivot axis is rearward of the suction inlet.

In some embodiments, the first axis is positioned between a first vertical plane defined by the front edge of the base and a second vertical plane defined by the rear edge of the base. For example, the first axis may be positioned relative to a midpoint between the first vertical plane and the second vertical plane, wherein the first axis is between 30 mm forward of the midpoint and 30 mm rearward of the midpoint. In some embodiments, the first axis is between 20 mm forward of the midpoint and 20 mm rearward of the midpoint or between 10 mm forward of the midpoint and 10 mm rearward of the midpoint.

In some embodiments, the pad includes a first layer and a second layer, the second layer being a strip having a width from a front edge of the strip to a rear edge of the strip that is less than a width of the first layer. In some embodiments, the first axis is positioned between a first vertical plane defined by the front edge of the strip and a second vertical plane defined by the rear edge of the strip.

Further provided is a cleaning device including a handle assembly including a proximal end and a distal end, a mounting section or base having a front edge and a rear edge defining a width, a hinge between the distal end of the handle assembly and the base, the hinge defining a first axis between the hinge and the base, a replacement head removably attachable to the base, the replacement head including a pad defining a lower surface of the cleaning device. The first axis is perpendicular to a cross-sectional plane extending centrally through the width of the base, the first axis positioned within an area on the plane above the lower surface of the cleaning device, rearward of a first point located the lower surface at least one-fourth of a distance from the front edge to the rear edge, and forward of a second point located on the lower surface up to three-fourths of the distance from the front edge to the rear edge.

In some embodiments, the first axis is below a third point 60 mm above the lower surface of the cleaning device. In some embodiments, the first point is located at least 40% of the distance from the front edge to the rear edge and/or the second point is located up to 60% of the distance from the front edge to the rear edge.

In some embodiments, the area is a trapezoid defined by the first point, the second point, a third point a height above the lower surface and about 50% of the distance from the front edge to the rear edge, and fourth point the height above the lower surface and about 75% of the distance from the front edge to the rear edge. In some embodiments, the height is equal to a distance less than 45% of the width.

Other objects of the invention and its particular features and advantages will become more apparent from consideration of the following drawings and accompanied detailed description.

DETAILED DESCRIPTION OF THE INVENTION

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure.

A cleaning device is disclosed herein of the type described in commonly owned U.S. patent application Ser. Nos. 16/670,039, 16/670,103, 16/670,319, and 16/670,476, each filed on Oct. 31, 2019, the contents of which are incorporated herein by reference.

Figure 1:
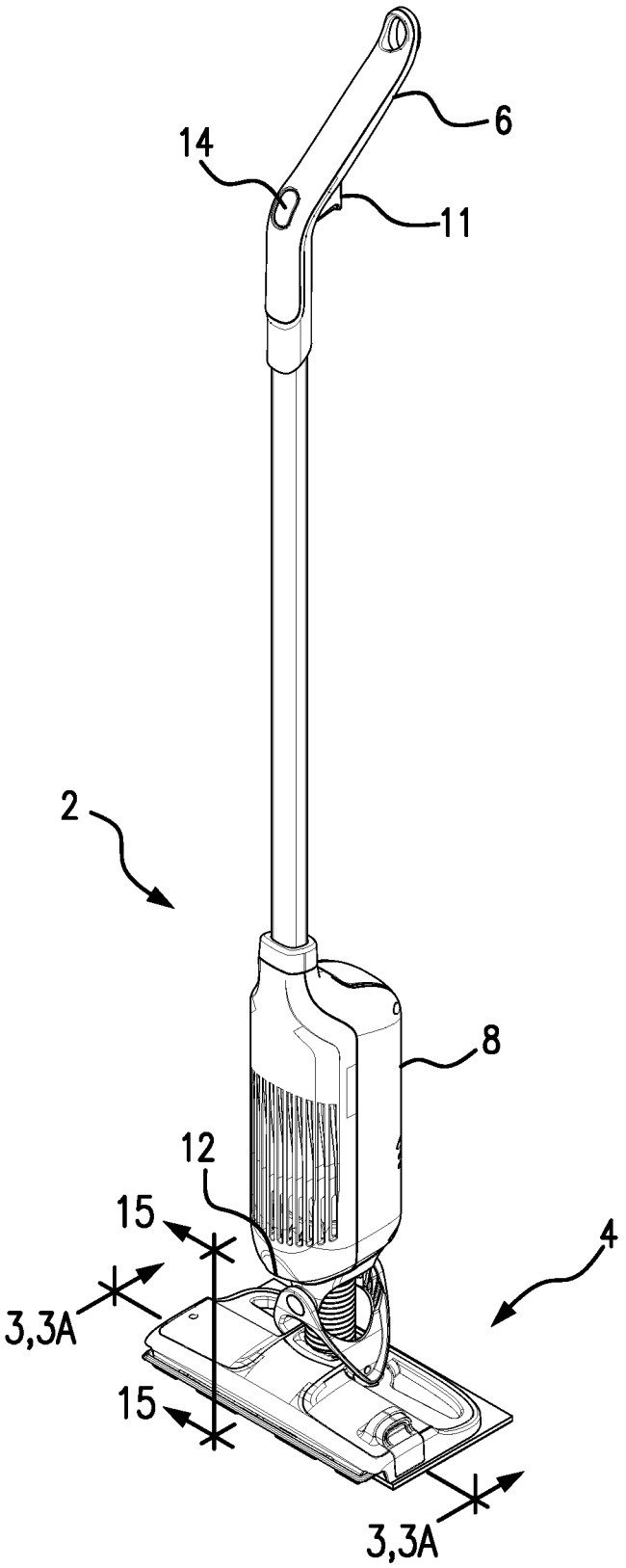
FIG. 1 shows an isometric view of a cleaning device of the present invention with a replacement head of the cleaning device attached.
Figure 2:
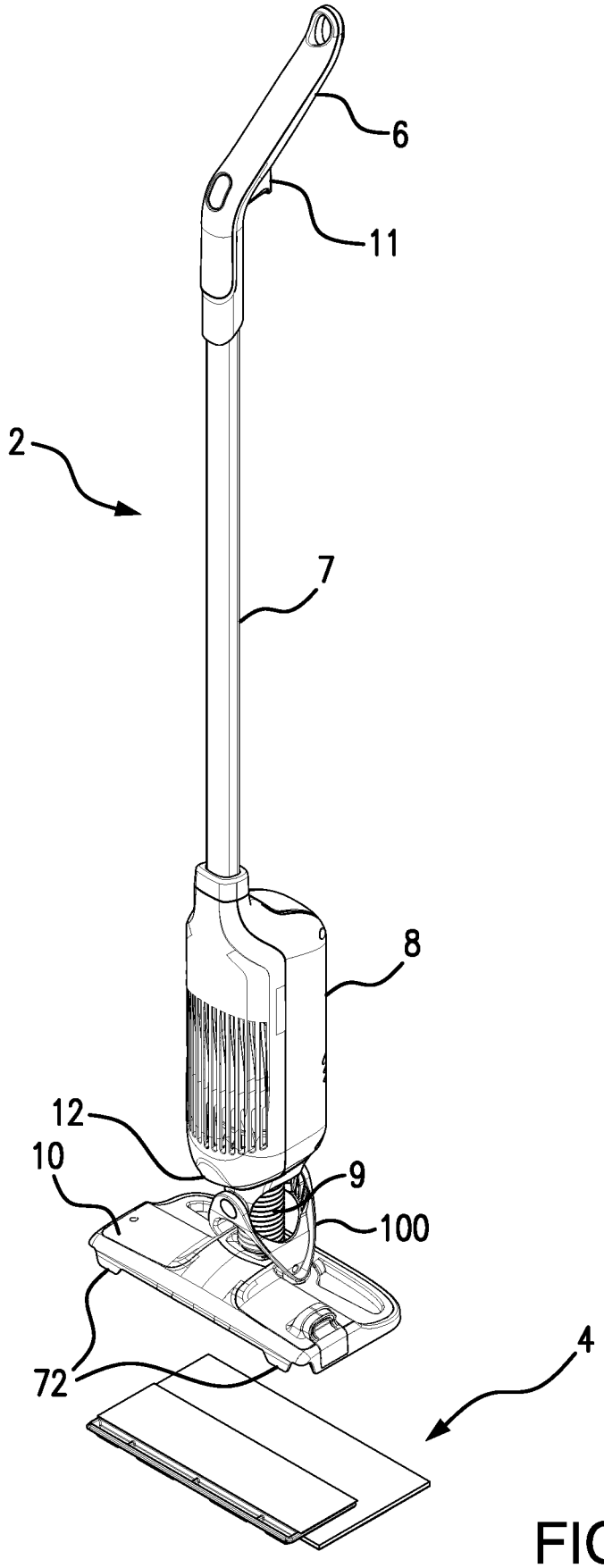
FIG. 2 shows an isometric view of the cleaning device of FIG. 1 with the replacement head separated.

FIGS. 1 and 2 illustrate isometric views of a cleaning device 2 according to an exemplary embodiment of the present invention. A top portion or handle assembly of the cleaning device 2 includes a handle 6, an elongated shaft 7, and a body or vacuum body 8 which includes a suction source (not visible). The handle 6 includes a trigger 11 for selectively activating the suction source to initiate vacuuming via a replacement head 4 connected to a base or vacuum base 10. The top portion or handle assembly of the cleaning device 2 may also include a container (e.g., within the vacuum body) for holding a fluid (e.g., a cleaning fluid), a jet nozzle 12 and a user-activated button 14 to selectively spray the fluid from the jet nozzle 12. The jet nozzle 12 is preferably aimed to spray fluid from the jet nozzle 12 to a position in front of the base 10 when the button 14 is activated by the user during normal use.

A bottom portion of the cleaning device 2 includes the base 10 rotatably connected to the top portion or handle assembly of the cleaning device 2 via a hinge 100. In the exemplary embodiment, the hinge 100 enables both fore and aft and left and right rotation between the top and bottom portions of the cleaning device 2. The hinge 100 is pivotably connected to a distal end of the handle assembly of the cleaning device 2. For example, in the exemplary embodiment, the hinge 100 is pivotably connected to a bottom of the vacuum body 8. The hinge 100 is also pivotably connected to the base 10. A vacuum hose 9 extends through the hinge 100 from the vacuum body 2 to the base 10. The cleaning device 2 further includes the replacement head 4 that can be selectively attached to and detached from the bottom of the base 10.

Figure 3:
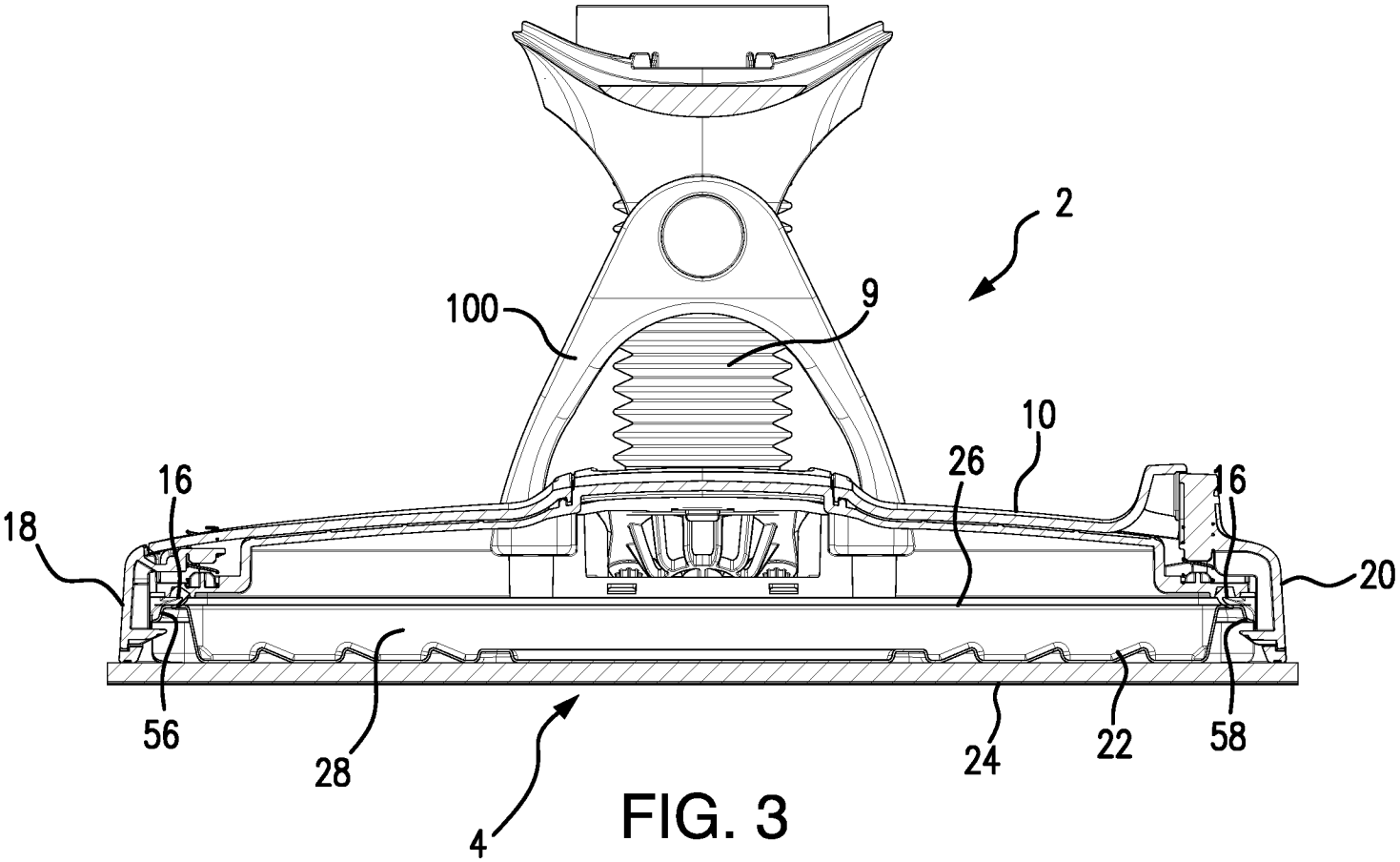
FIG. 3 shows a cross-sectional view of FIG. 1 along line 3-3 showing a base of the cleaning device with the replacement head attached and connector arms in a locked position.
Figure 3A:
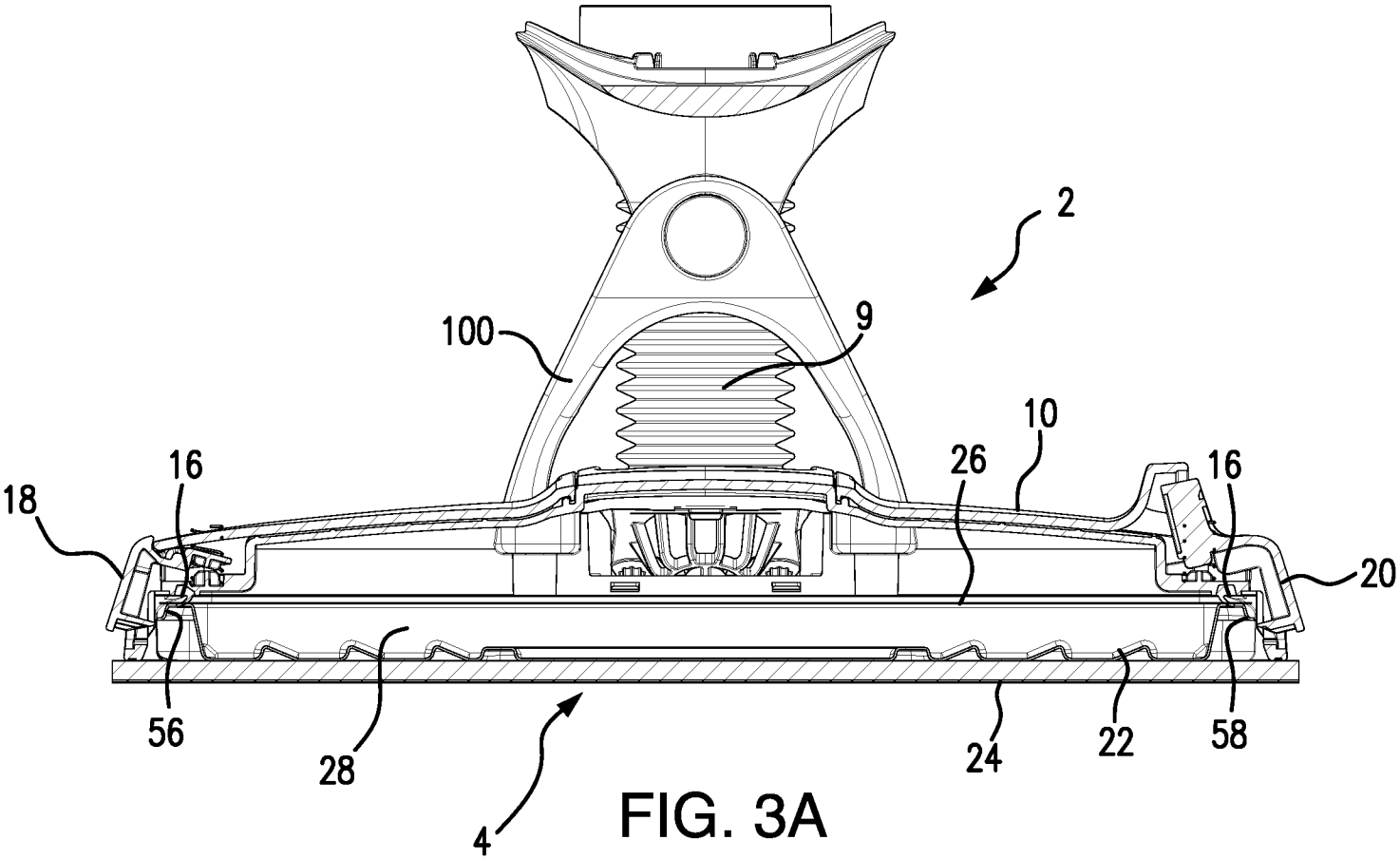
FIG. 3A shows a cross-sectional view of FIG. 1 along line 3A-3A showing the base with the replacement head attached and the connector arms in an open position.

FIGS. 3 and 3A are cross-sectional views of the cleaning device 2. The base 10 includes a sealing surface or vacuum sealing surface 16 and at least one connector arm 18, 20. In the exemplary embodiment, at least one the connector arms 18, 20 are movable between a closed position (FIG. 3) to retain the replacement head 4 and an open position (FIG. 3A) to release the replacement head 4. In the exemplary embodiment, the connector arm 20 has toggle arm to enable a user to open and close the connector arm 20.

Figure 4:
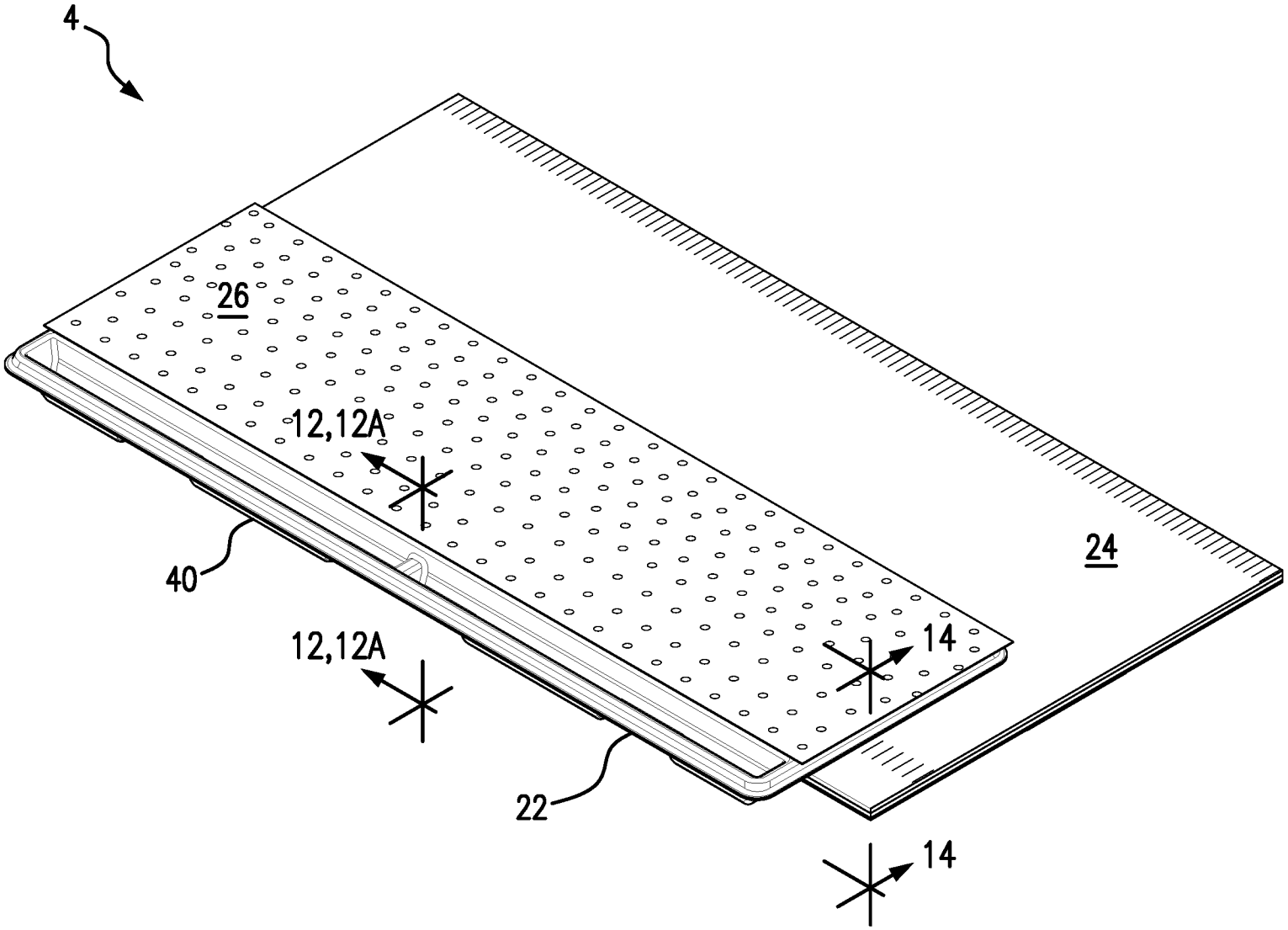
FIG. 4 shows a top isometric view of the replacement head of the cleaning device shown in FIG. 1.
Figure 5:
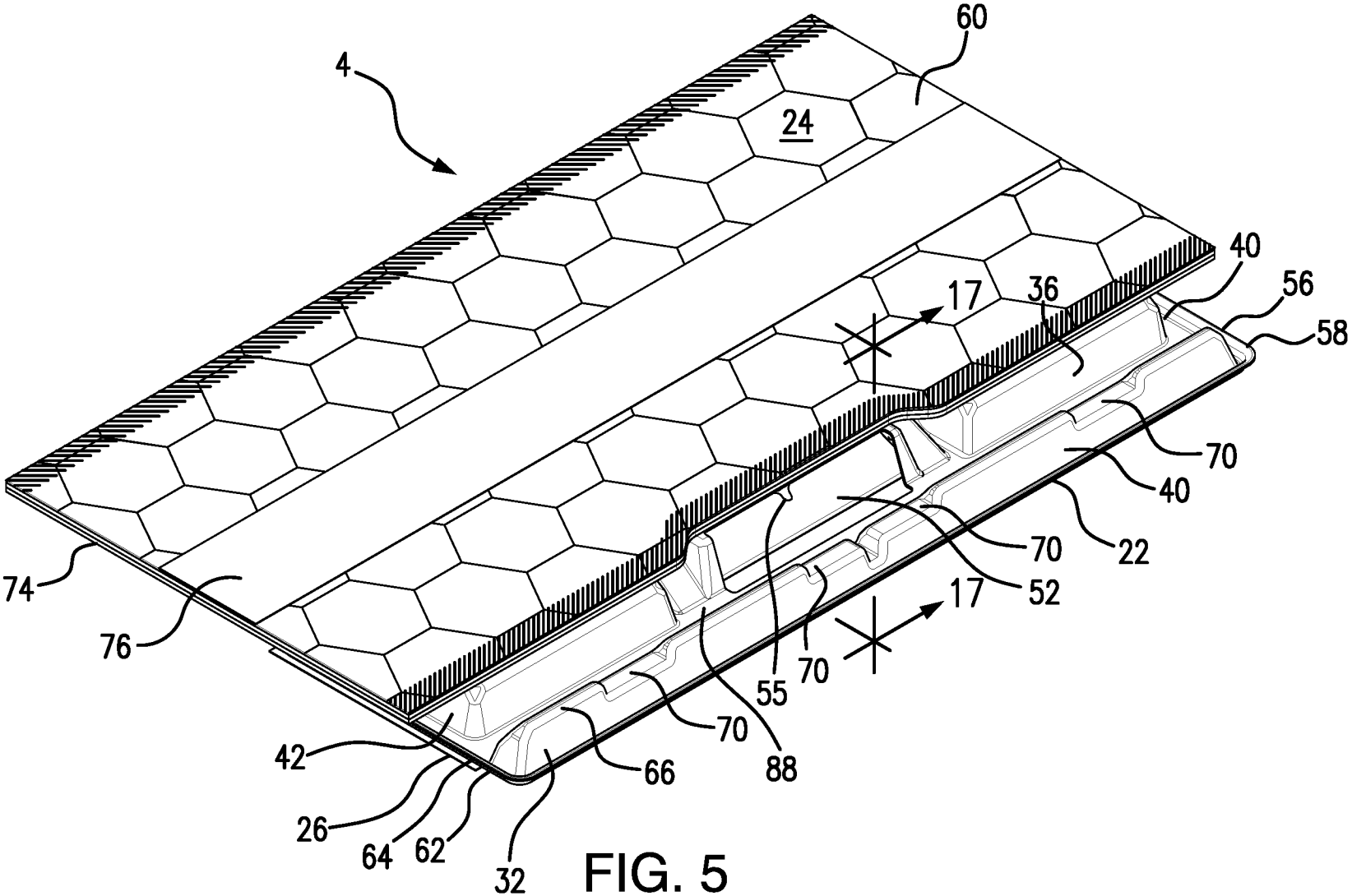
FIG. 5 shows a bottom isometric view of the replacement head of FIG. 4.
Figure 6:
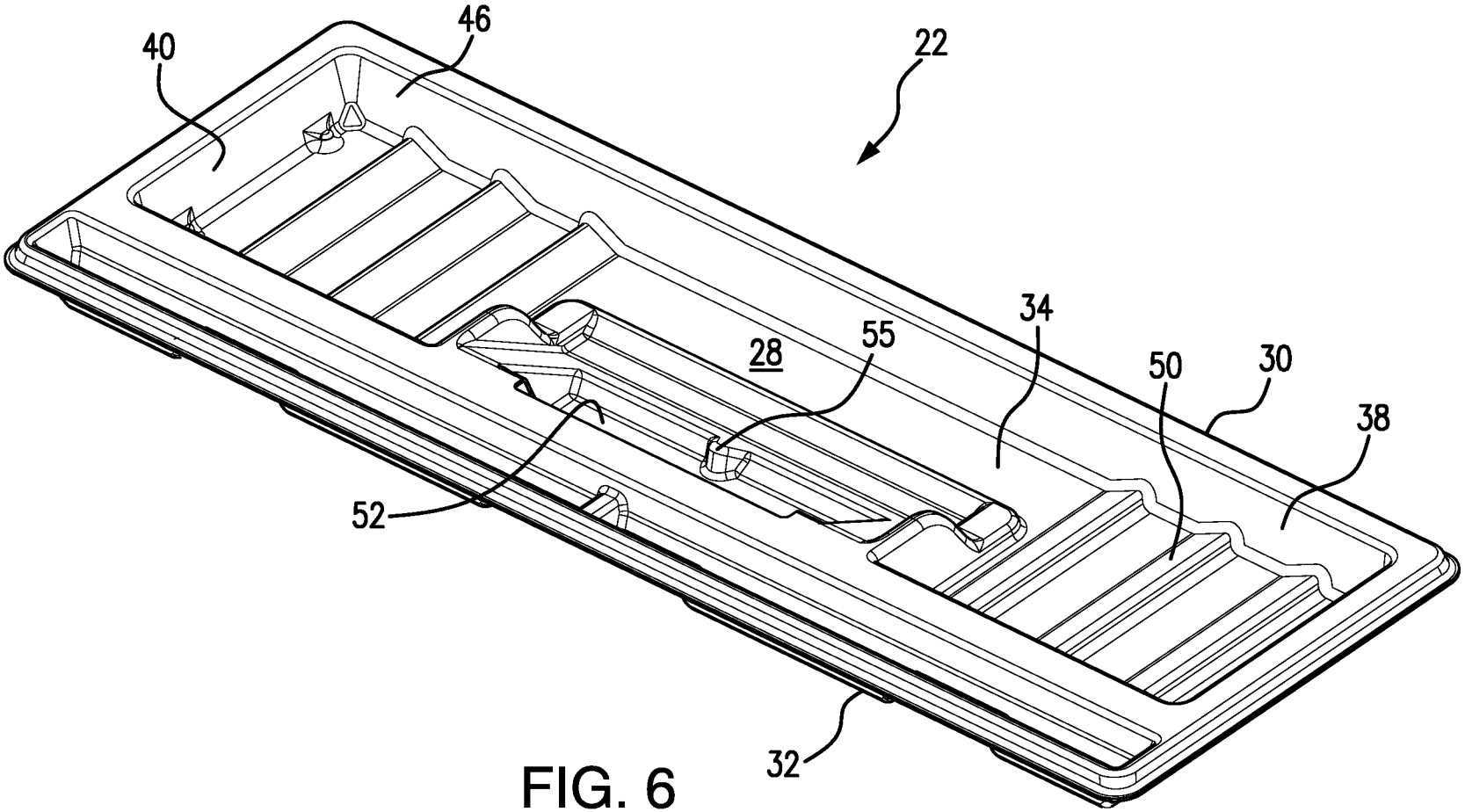
FIG. 6 shows an isometric view of a plastic tray of the replacement head shown in FIGS. 4 and 5.
Figure 7:
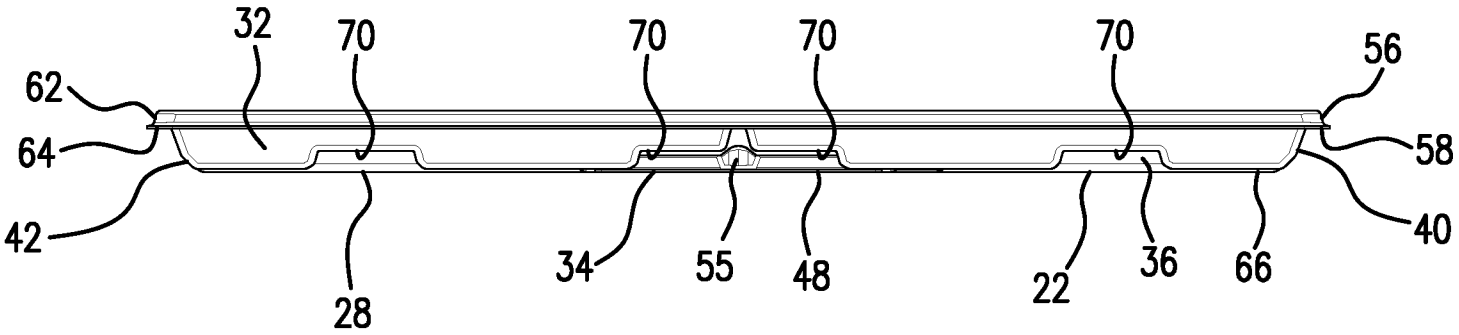
FIG. 7 shows a front view of the plastic tray of the replacement head shown in FIGS. 4 and 5.
Figure 8:
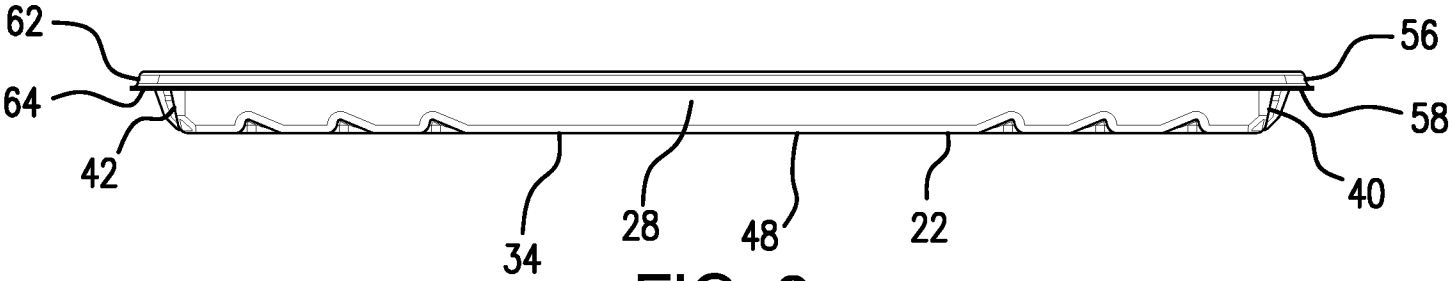
FIG. 8 shows a rear view of the plastic tray of the replacement head shown in FIGS. 4 and 5.

FIGS. 4-6 illustrate an exemplary embodiment of the replacement head 4 of the cleaning device 2. Referring now to FIGS. 4-6, the replacement head 4 includes a plastic tray 22, a pad 24, and a filter 26. The plastic tray 22 includes a dust chamber 28, a sealing surface 30 (see, e.g., FIG. 6) and a front guard portion 40.

The plastic tray 22 can be made of any suitable material (including non-plastics); however, materials that are inexpensive and readily disposable are preferred. For example, polyethylene terephthalate (or "PET") is considered a preferred material, in part, because PET is inexpensive and is readily thermoformed to the desired shape. Injection molding, blow molding or any other common manufacturing processes would also be acceptable and appropriate alternatives. As shown, the plastic tray 22 can be formed of a single, unitary piece, or can be comprised of two or more parts that are connected or joined during the assembly of the replacement head 4.

Figure 9:
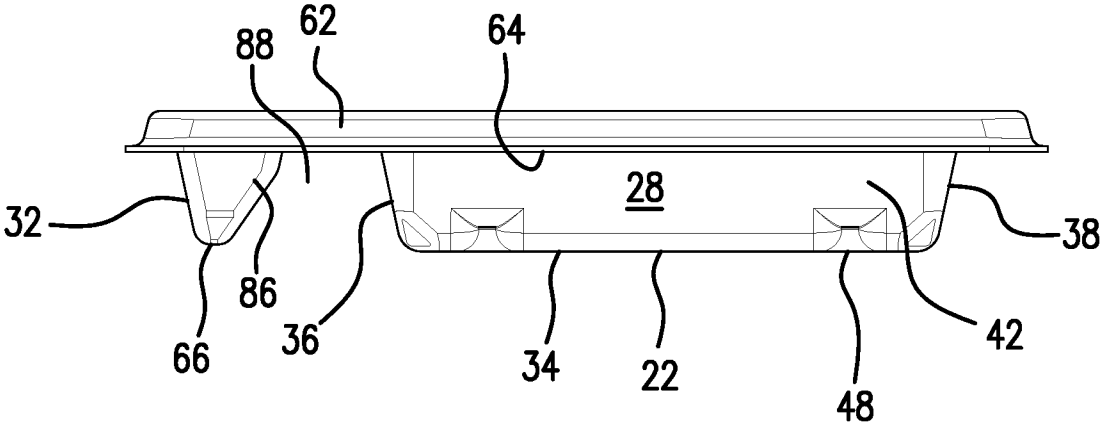
FIG. 9 shows a side view of the plastic tray of the replacement head shown in FIGS. 4 and 5.
Figure 10:
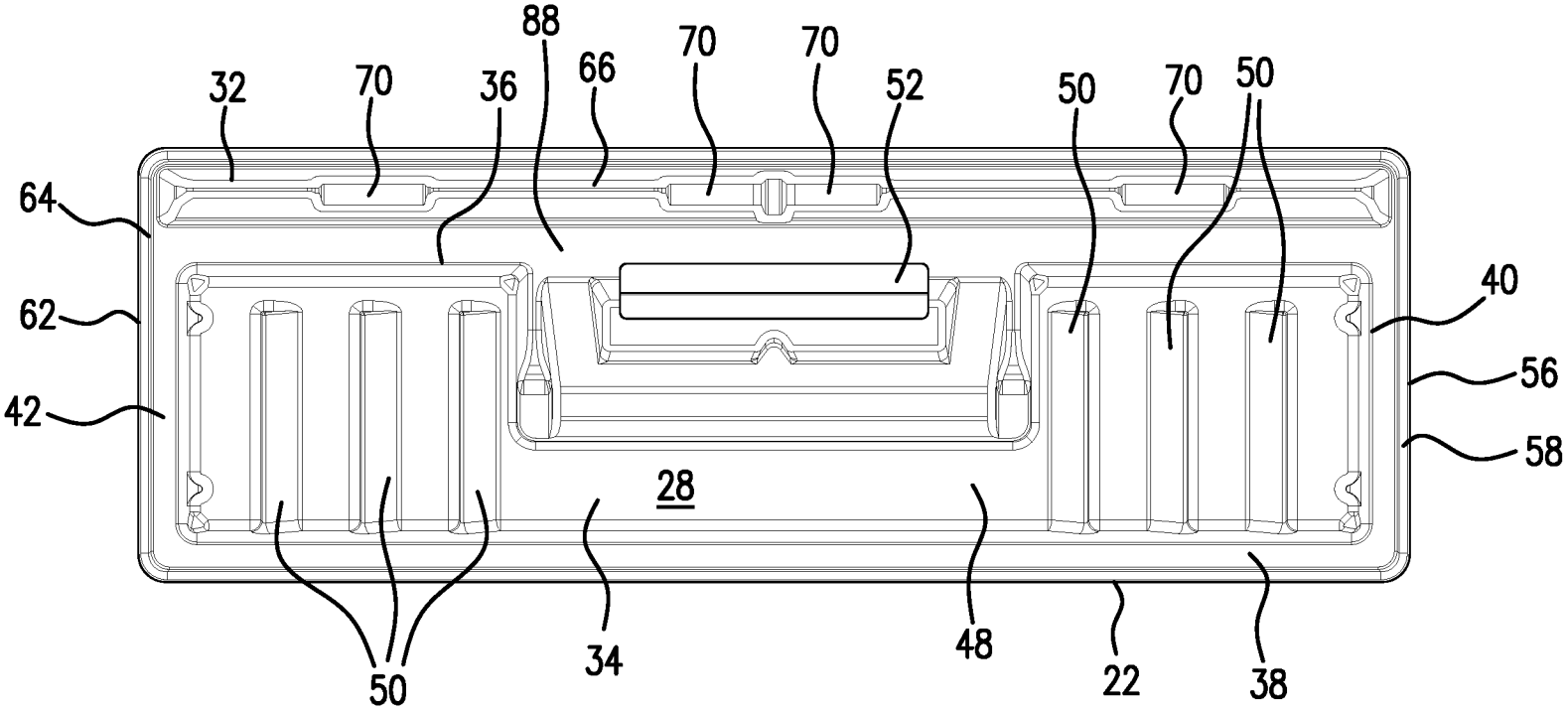
FIG. 10 shows a bottom view of the plastic tray of the replacement head shown in FIGS. 4 and 5.

The plastic tray 22 of the replacement head 4, as shown in FIGS. 6-12, includes the dust chamber 28 which is sized and shaped to collect and retain dust and debris that is suctioned into the plastic tray 22 during use. In the embodiment shown, the dust chamber 28 has a bottom wall 34, a front wall 36, a rear wall 38, a left wall 40, and a right wall 42. At the top of the dust chamber 28 is a top opening 46 which is closed by the filter 26. Together, the walls and the top opening 46 which is closed by the filter 26 generally define a volume of space capable of collecting and retaining common household dust and debris. One of skill in the art would understand that varying the size and shape of the walls and top opening 46 would increase or decrease the overall volume of the dust chamber without departing from the spirit of the invention. Although the rear wall 38, and left and right walls 40, 42 are shown as generally straight in FIGS. 9 and 10, the walls can include at least one curve or a bend, or include other features that make them not straight. For example, the front wall 36, as shown in FIG. 10, includes a series of curves and features. The curves and bends, among other benefits, increase the structural stability without increasing the thickness of the material. The bottom wall 34 defines a bottom surface 48 and may include ridges 50 (see FIGS. 8 and 10) to assist with retaining dust in place that has collected at the bottom of the dust chamber 28 during use. Alternatively, the bottom wall 34 can be generally flat.

Referencing now to FIGS. 3, 3A, 6 and 11, a sealing surface 30 extends circumferentially around the top opening 46 of the plastic tray 28. The sealing surface 30 is complementary to the sealing surface 16 on the base 10. The sealing surface 30 and the sealing surface 16 are either directly or (preferably) indirectly in contact with one another during use. In a preferred embodiment, where the sealing surface 30 and the sealing surface 16 are indirectly in contact, the filter 26 may be sandwiched therebetween during use (see e.g., FIG. 3). To facilitate an effective seal that prevents a loss of suction during use, the sealing surface 30 must be held in place with enough force against the sealing surface 16. In the embodiment shown, the sealing surface 30 is a generally rectangular ring with a generally flat surface. The term generally rectangular is intended to describe a shape with a width greater than a length, or vice versa. However, the shape is not intended to be limited to a precise rectangle. For example, as shown in e.g., FIG. 10, the generally rectangular shape includes corners that are rounded. Other embodiments could have chamfered corners, or non-straight sidewalls.

Referring to FIGS. 5-6 and 10-12A, at least one opening 52 exists that enables air, dust and debris to be drawn in from a position outside the replacement head 4 into the dust chamber 28 during use. In a preferred embodiment, a single rectangular-shaped opening 52 is located on the front wall 36 of the dust chamber 28. One of skill in the art would understand that alternative embodiments, although not shown, could include: multiple openings on a single wall; an opening that extends over two or more adjacent walls; at least opening on one wall, and another opening on another wall; or any combination of the above alternatives.

The opening 52 is preferably covered by an opening cover 54. The opening cover 54 can be made of any suitable material; however, in two preferred embodiments the material is either spunbond polypropylene, 1.25 oz and extruded PET, 0.7 Mil or 80 gsm spunbond PP. Preferably, the opening cover 54 is a cantilevered flap that, when open (FIG. 12A), permits air, dust and debris to enter into the dust chamber and, when closed (FIG. 12), generally covers the opening 52 to retain collected dust and debris within the dust chamber 28. While the cantilevered flap described above is a cost-effective solution, alternatives can include, for example, an opening cover 54 that is made of plastic or metal. The opening cover 54 is, preferably, attached to the underside of the filter 26. However, although not shown, the opening cover 54 can, for example, be attached to the plastic tray. In addition, while the preferred embodiment generally relies on the flexibility and resiliency of the opening cover 54 material employed, the opening cover 54 can also employ a hinge that defines a pivot axis, or a living hinge.

In some embodiments, and now referring FIG. 5, the opening 52 may further include an opening rib 55. The opening rib 55 is preferably integral with the dust chamber 28 and provides a stop surface to prevent the opening cover 54 from becoming either stuck in the opening 52 or from exiting the opening 52 during either shipment or normal use.

Figure 13:
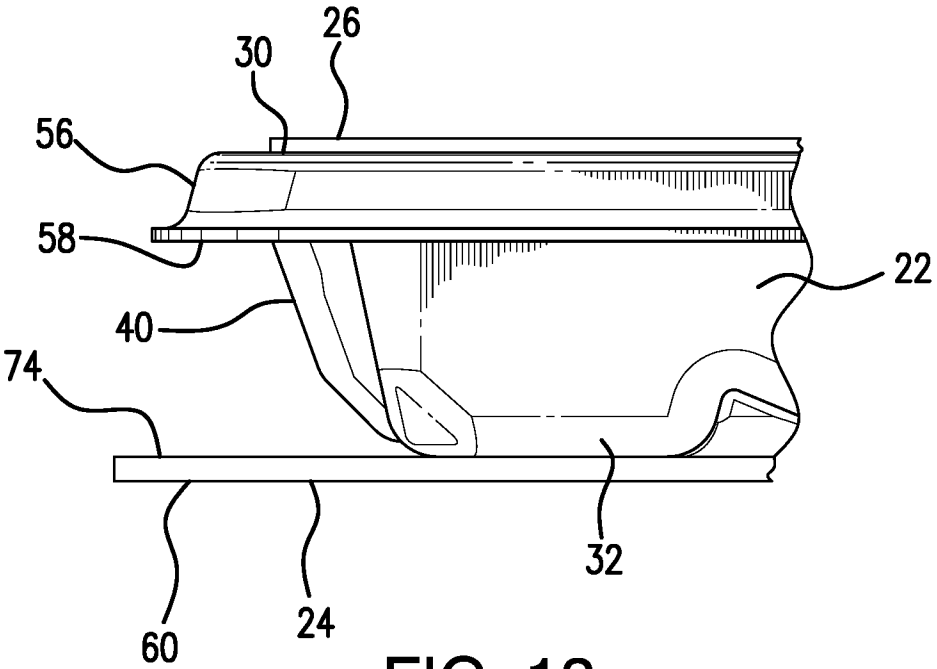
FIG. 13 shows an enlarged front view of one side of the replacement head shown in FIGS. 4 and 5.
Figure 14:
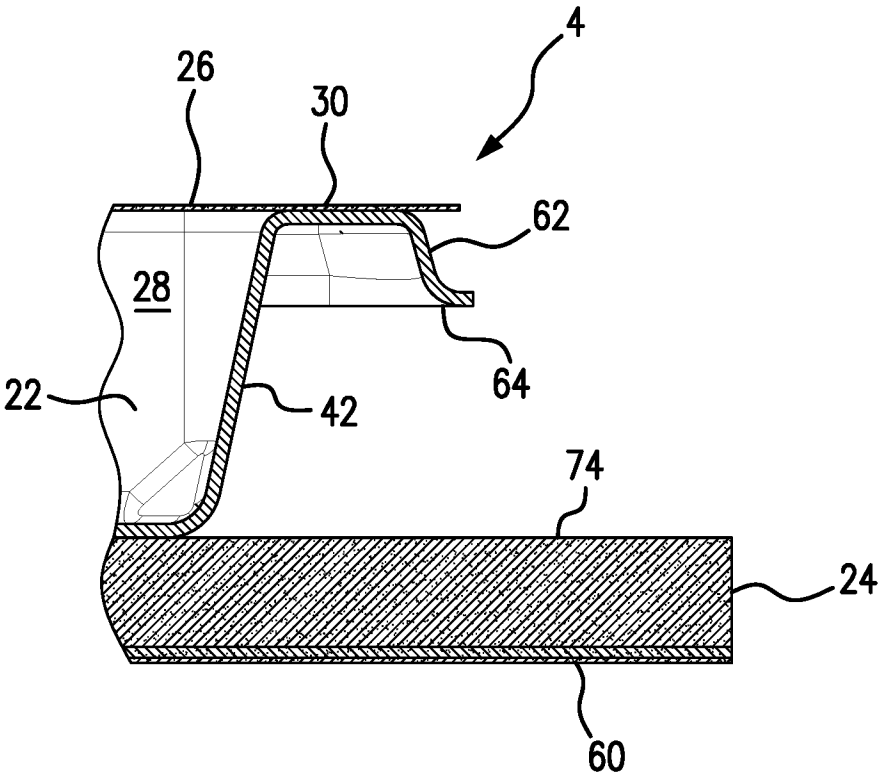
FIG. 14 shows a cross-sectional view of FIG. 4 along line 14-14 depicting a shape of a first connector lip.
Figure 15:
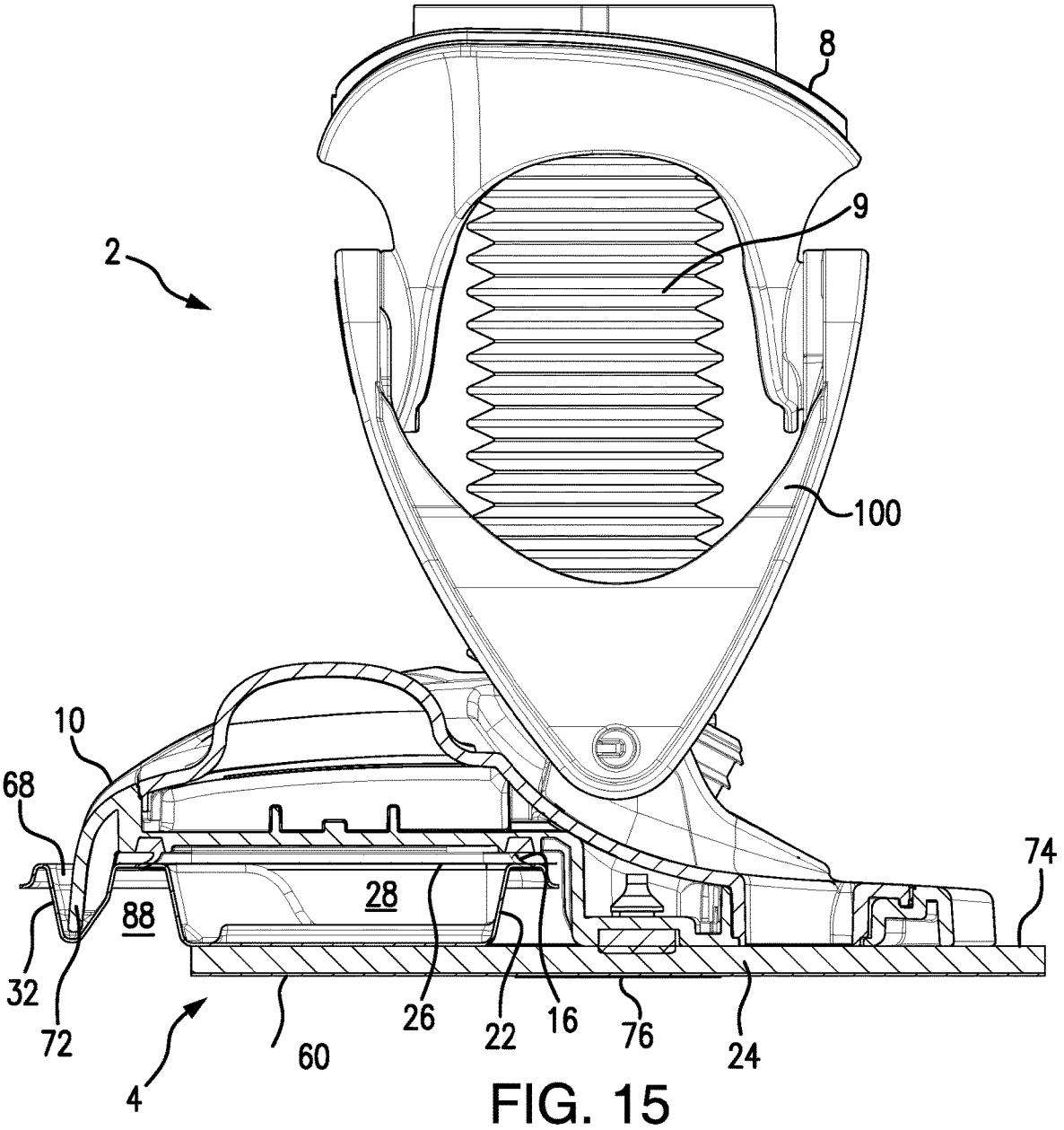
FIG. 15 shows a cross-sectional view of FIG. 1 along line 15-15 depicting an interaction between the base and a front guard of the plastic tray.

Referring to FIGS. 7-11 and 13, a first connector lip 56 extends outwards from the left wall 40 of the dust chamber 28, outside of the sealing surface 30. Also, at least a portion of the first connector lip 56 is located between the front wall 36 and the rear wall 38 of the dust chamber, as shown, e.g., in FIG. 11. The first connector lip 56 includes a lower surface 58 that is located below the sealing surface 30. More particularly, and as shown in FIGS. 13 and 14, the lower surface 58 of the first connector lip 56 is located between the level of the sealing surface 30 and the second surface 60 of the pad 24 (described in greater detail below). Even more particularly, the lower surface 58 of the first connector lip 56, in some embodiments, is closer to the sealing surface 30 than the second surface 60 of the pad 24. The cross-sectional shape of the first connector lip 56 may be of any chosen by the designer. However, it is preferred, in order to increase rigidity and reduce material, that the first connector lip 56 has a cross-sectional shape that includes at least one curve. The actual relative positioning of the lower surface 58 of the first connector lip 56 should be complementary to the design of the of the base 10 and connector arms 18, 20. In the locked position, as shown in FIG. 3, the connector arms 18, 20 of the base engage with the lower surface 58 of the first connector lip 56. When held in position by the connector arms 18, 20 of the base 10, the sealing surface 30 of the replacement head 4 is engaged with, either directly or indirectly, sealing surface 16.

Figure 11:
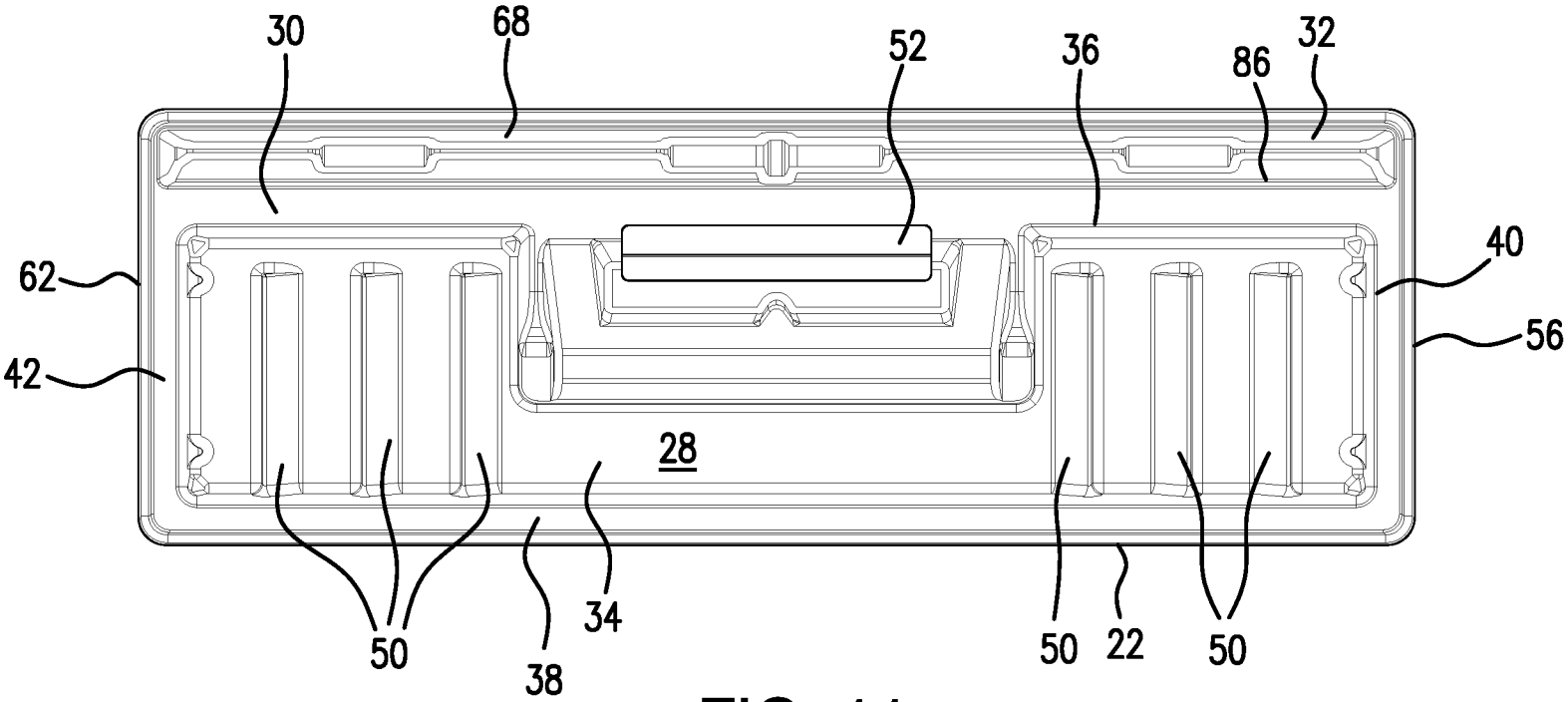
FIG. 11 shows a top view of the plastic tray of the replacement head shown in FIGS. 4 and 5.

In some embodiments, and now referring to FIGS. 10 and 11, the first connector lip 56 may extend rearward of the rear wall 38 and/or further forward of the front wall 36. In even further embodiments, the first connector lip 56 may extend forward of the front guard 32 (described below). The first connector lip 56 may be formed integrally with the other features of the plastic tray 22 (e.g., the dust chamber), or may be a separate element that is combined with the remaining features of the plastic tray 22 prior to end use.

Referring to FIGS. 7-11 and 13, a second connector lip 62 extends outwards from the right wall 42 of the dust chamber 28, outside of the sealing surface 30. Also, at least a portion of the second connector lip 62 is located between the front wall 36 and the rear wall 38 of the dust chamber 28, as shown, e.g., in FIGS. 10 and 11. Similar to the first connector lip 56 shown in FIGS. 13 and 14, the second connector lip 62 includes a lower surface 64 that is located below the level of the sealing surface 30 (see e.g., FIGS. 7 and 8). More particularly, the lower surface 64 of the second connector lip 62 is located between the level of the sealing surface 30 and the second surface 60 of the pad 24 (described in greater detail below). Even more particularly, the lower surface 64 of the second connector lip 62, in some embodiments, is closer to the sealing surface 30 than the second surface 60 of the pad 24. The cross-sectional shape of the second connector lip 62 may be of any chosen by the designer and may be the same as, or different than, the first connector lip 56. It is preferred that the second connector lip 62, for the same reasons stated above, has a cross-sectional shape that includes at least one curve. The relative positioning of the lower surface 64 of the second connector lip 62 should be set such that it is complementary to the design of the of the base 4 and connector arms 18, 20. In the locked position, as shown in FIG. 3, the connector arms 18, 20 of the base 4 engage with the lower surface 64 of the first connector lip 56. When held in position by the connector arms 18, 20 of the base, the sealing surface 30 of the replacement head 4 is engaged with, either directly or indirectly, sealing surface 16.

In some embodiments, and now referring to FIGS. 10 and 11, the second connector lip 62 may extend rearward of the rear wall 38 and/or further forward of the front wall 36. In even further embodiments, the second connector lip 62 may extend forward of the front guard 32 (described below). The second connector lip 62 may be formed integrally with the other features of the plastic tray 22 (e.g., the dust chamber 28), or may be a separate element that is combined with the remaining features of the plastic tray 28 prior to end use. In some embodiments, the first and second connector lips 56, 62 may be separate elements while, in other embodiments, such as the embodiment shown in, e.g., FIG. 6, the first and second connector lips 56, 62 may be interconnected across the front and/or rear of the plastic tray 22.

Referring now to FIGS. 5, 7, 9 and 10, the plastic tray 22 can include a front guard portion 32 that is located at least partially forward of the dust chamber 28. In the embodiment shown, the front guard portion 32 is located forward of the dust chamber 28 and defines a shaped bottom surface 66 and an interior space 68 and extends generally from the right side of the plastic tray 22 to left side. The cross-sectional shape of the front guard 32 can be any suitable shape; however, a generally triangular cross-section (as shown in FIG. 9) has been shown to have particular utility. The lowest portion of the bottom surface 66 is preferably in close proximity to the floor being cleaned to assist in controlling the airflow into the dust chamber 28. In some embodiments, as shown in, e.g., FIGS. 5 and 7, it is preferable that the front guard 32 includes one or more castellations 70. While it is desirable for sections of the front guard 32 to be in close proximity to the ground during the cleaning process, the castellations 70 provide sections that permit larger pieces of debris (e.g., pieces of cereal) to come into close proximity to the opening 52 of the dust chamber 28 in order to be drawn into the dust chamber 28. The interior space 68 of the front guard 32, as shown in FIGS. 11, provides space to receive corresponding, complementary features 72 on the base 10. Preferably, the interior space 68 is located at an asymmetrical location on the plastic tray 22 such that, if the replacement head 4 were to be unintentionally reversed by the end user, the features on the front of the base 10 would contact plastic tray material (e.g., the sealing ring 30), thus cueing the end user that the replacement head 4 is being attached incorrectly. The base 10 may include a single feature that enters the interior space 68 of the front guard 32 during attachment, or, as shown in FIG. 3, may include multiple features. As noted above, the interior space 68 may be generally triangular in shape. In these embodiments, the generally converging walls of the interior space 68 function to assist the user to position the base 10 into the proper attachment position by urging the base either slightly forwards or backwards during attachment.

Referring now to FIG. 9, the interior space 68 may have a partial vertical wall 86 on the side closer to the dust chamber 28. The partial vertical wall 86 can interact with features on the base 10 to prevent motion relative to the base 10 during a pull-back stroke.

Located between the front guard portion 32 and the dust chamber 28 is the front suction chamber 88. The front suction chamber 88 extends across the plastic tray 22 from side to side. The front suction chamber 88, as shown in FIG. 9, is bounded on the front by the rear side of the front guard portion 32 and at the rear by the front wall 36 of the dust chamber and the opening 52. The size and shape can be determined by the designer; however, it is preferable to shape the front suction chamber 88 in such a manner to encourage airflow to direct dust, dirt towards the opening(s) 52.

The filter 26 is made of a suitable material that will permit air to pass therethrough during use, yet block at least a substantial portion of the dust that is drawn into the dust chamber 28 during cleaning. In addition, it is desirable for the filter 26 to have the ability to absorb and/or block moisture prior to entering the cleaning device 2. It is desirable to choose a material that is inexpensive to manufacture, readily cut to size and easily attachable to the plastic tray 22. In the embodiment shown, the filter 26 is a non-woven, hydrophobic material made of SMS Polypropylene, 40 gsm. In embodiments where the filter material is printable, an additional printed pattern may appear on the filter 26 that includes, e.g., a logo or directions for use.

The filter 26 is attached to the plastic tray 22, such that substantially the entire top opening 46 is covered, as shown in FIG. 4. It is desirable that most, if not all, of the air that is drawn into the dust chamber 28 during vacuuming passes through the filter 26 prior to entering the cleaning device 2 so that the amount of dust, debris and moisture that enters into, and therefore can potentially damage, the suction source is minimized. In the embodiment shown in FIG. 3, the filter 26 is attached to the sealing surface 30 such that, when the replacement head 4 is attached to the base 10, the filter 26 is sandwiched between the sealing surface 30 of the plastic tray 22 and the sealing surface 16. While it is desirable for the filter 26 to cover substantially all of the top opening 46 of the dust chamber 28, it is preferable that the filter 26 does not cover interior space 68 of the front guard 32 so that features 72 on the base 10 can enter into the interior space 68 of the front guard 32 unimpeded during attachment. The filter 26 may be attached to the plastic tray 22 in any acceptable manner. Suitable methods include using heat to bond the materials together, as well as the use of glues and adhesives. While it is preferable that the filter 26 is attached in a permanent manner to the plastic tray 22, other embodiments can have a removable connection. Even further embodiments can include an end user placing the filter 26 over the top opening 46 during use.

Pads 24 are well-known in the art and can include one or more layers. For example, a pad with a single layer made of 100% PET material or Carded Spunlace PET, 58 gsm; Spunbond PP, 10 gsm may be used. In other embodiments, the pad 24 may have multiple layers such as four layers that each provide utility (e.g., absorption, retention, scrubbing), such as an air laid retention layer (180 gsm, 47% Pulp, 53% Bico), an air laid acquisition layer (100 gsm, 47% Pulp, 53% Bico), a face layer (Carded Spunlace PET, 58 gsm; Spunbond PP, 10 gsm), and multi-function or scrubbing strip (Melt Blown PP, 35 gsm).

As shown in FIG. 5, the pad 24 according to the exemplary embodiment includes a first (upper facing) surface 74 and a second (lower facing) surface 60 and is made from any suitable material that, preferably, can be used to scrub the surface being cleaned and/or absorb moisture. The pad 24 further includes an additional layer being a scrubbing strip 76 extending lengthwise (side to side) across a center portion of the pad 24. The scrubbing strip 76 is made from a suitable material that can be used to scrub and loosen of debris to be absorbed by the pad 24 and/or suctioned into the dust chamber 28. The layers of the pad 24 may be attached to one another, for example, by ultrasonic welding.

In the exemplary embodiment, the scrubbing strip 76 has a length (side to side) approximately equal to length of the pad 24 and a width (front to back) of approximately 20-30% of the width of the pad 24. For example, the pad 24 may have a length of approximately 200-300 mm, preferably 225-275 mm, and more preferably about 250 mm, and a width of approximately 75 to 175 mm, preferably 100-150 mm, and more preferably about 125 mm. Further, the scrubbing strip 76 may have a same length as the pad 24 and a width of approximately 10-60 mm, preferably 20-50 mm, and more preferably about 30 mm. However, the sizes of the pad 24 and the layers thereof may be adjusted to accommodate different applications.

The outer shape of the pad 24 can be any shape suitable known to one of skill in the art. As shown in FIG. 5, the pad 24 can be generally rectangular. The first surface 74 of the pad 24 is attached to the bottom surface 48 of the dust chamber 28 such that the second surface 60 of the pad 24 material is in contact with the floor during cleaning. Preferably, the first surface 74 of the pad 24 covers at least most of the bottom surface 48 of the dust chamber 28 and, even more preferably, covers the entirety. The pad 24 may extend outward from the bottom surface 48 of the dust chamber 28. As shown in FIGS. 4 and 5, the pad 24 extends rearward and to the sides of the bottom surface 48 of the plastic tray 28. Although it is acceptable for the pad 24 to extend forward of the front wall 36 of the dust chamber 28, such an arrangement has the potential to hinder usability by, e.g., blocking the opening 52 to the dust chamber 28 and/or the potentially causing the pad 24 to fold or buckle when the cleaning device 2 is pushed forward by the user during cleaning.

The pad 24 can be attached to the dust chamber 28 in any suitable manner. Preferably, the first surface 74 of the pad 24 is attached to the bottom surface 66 of the dust chamber 28 in a permanent manner. Suitable methods include using heat bonding or adhesives. Alternatively, the pad 24 can be replaceable and attached in a removable manner by, e.g., hook and loop fasteners.

Figure 12:
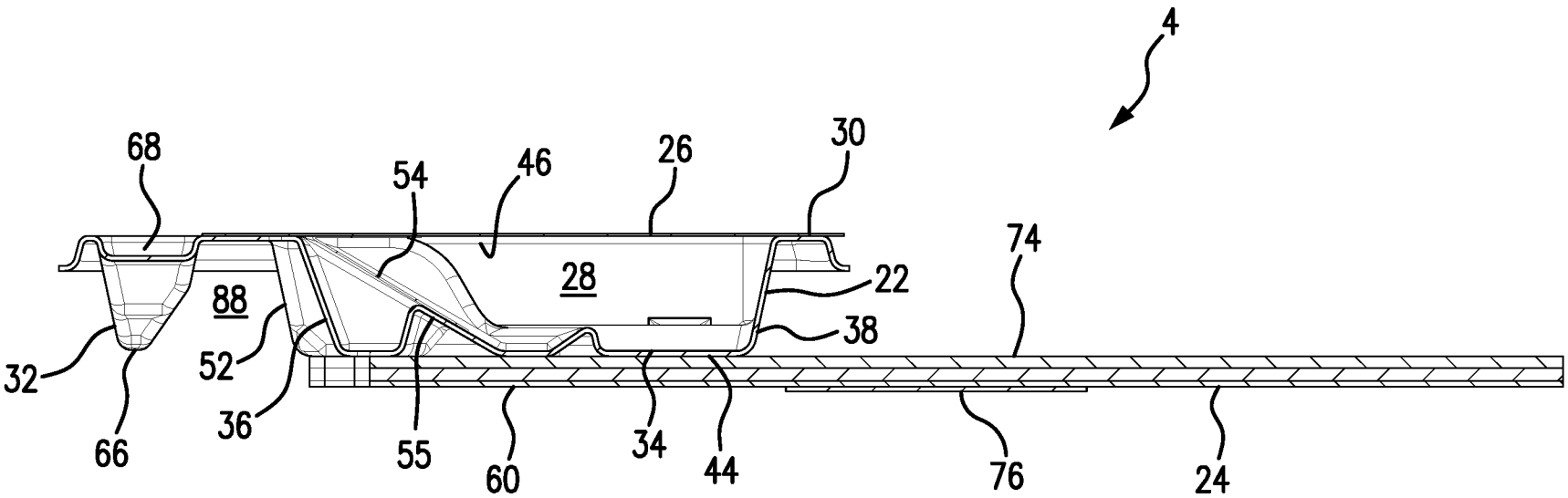
FIG. 12 shows a cross-sectional view of FIG. 4 along line 12-12 depicting an opening cover in a closed position.
Figure 12A:
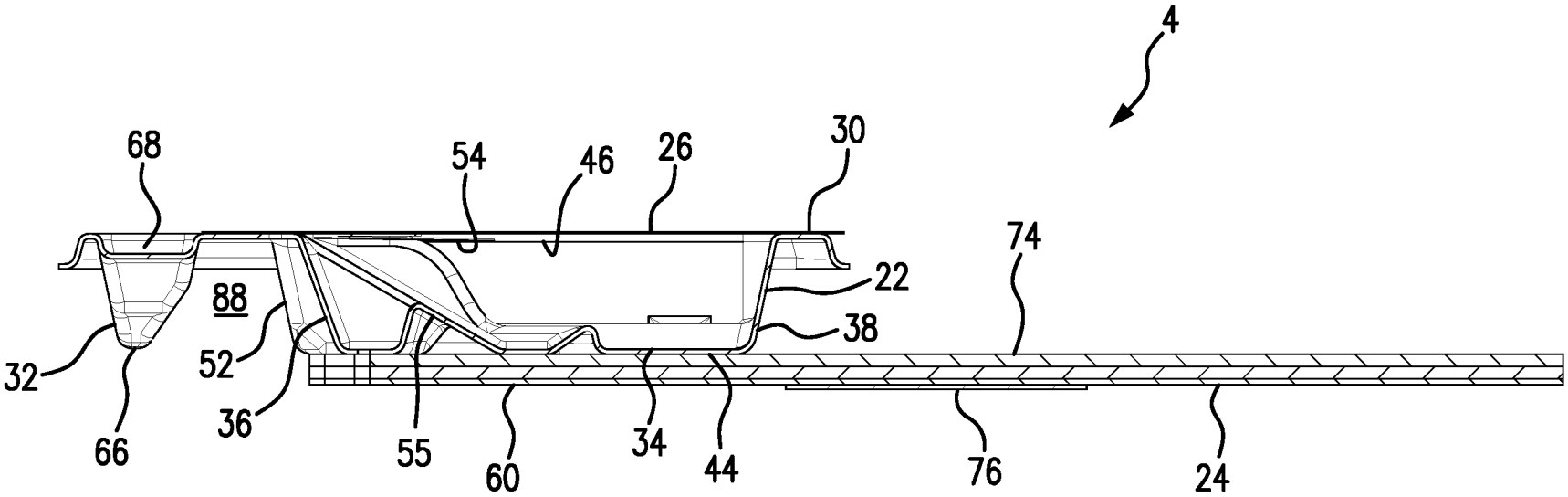
FIG. 12A shows a cross-sectional view of FIG. 4 along line 12A-12A depicting the opening cover in an open position.

In use, and now referring to FIGS. 1-3A, the end user moves at least one of the connector arms 18, 20 of the base 10 to the open position and places a replacement head 4 such that the filter 26 material is sandwiched between the sealing surface 30 of the plastic tray 22 and the sealing surface 16. The at least one connector arm 18, 20 is then released such that the connector arms engage the first and second connector lips 56, 62 on the plastic tray, holding the replacement head 4 in place for use. The user then activates the cleaning device 2, creating suction. The air drawn into the dust chamber 28 causes the opening cover 54 to move to an open position (as shown in FIG. 12A). As the user moves the cleaning device 2 and replacement head 4 over the floor to be cleaned, the suction source draws air, dirt and debris from the area in front of the replacement head 4 under the front guard 32, and through the opening 52 into the dust chamber 28. The air, dust and debris, once inside the dust chamber 28, are then drawn towards the filter 26 where the air passes through. The dust and debris are not able to pass through the filter 26 and are retained in the dust chamber 28. As desired, the user may activate the button 14 on the cleaning device 2 to spray fluid onto the floor in front of the replacement head 4. The user can then thoroughly clean the floor using the second surface 60 of the pad 24 to scrub the floor with cleaning fluid.

During the cleaning process, one or more of the following will occur: the dust chamber 28 will fill with dust and debris, the filter 26 will become clogged, and the pad 24 will become soiled. The user, at any time, may selectively replace the replacement head 4 by moving at least one of the connector arms 18, 20 to the open position, thereby releasing the first and second connector lips 56, 62 from engagement with the base 10. Advantageously, in the embodiment described, the user can replace the entire replacement head 4 all at once and replace with a refreshed replacement head 4 for future use with minimal mess. In the exemplary embodiment, the replacement head 4 is disposable after use.

Figure 16:
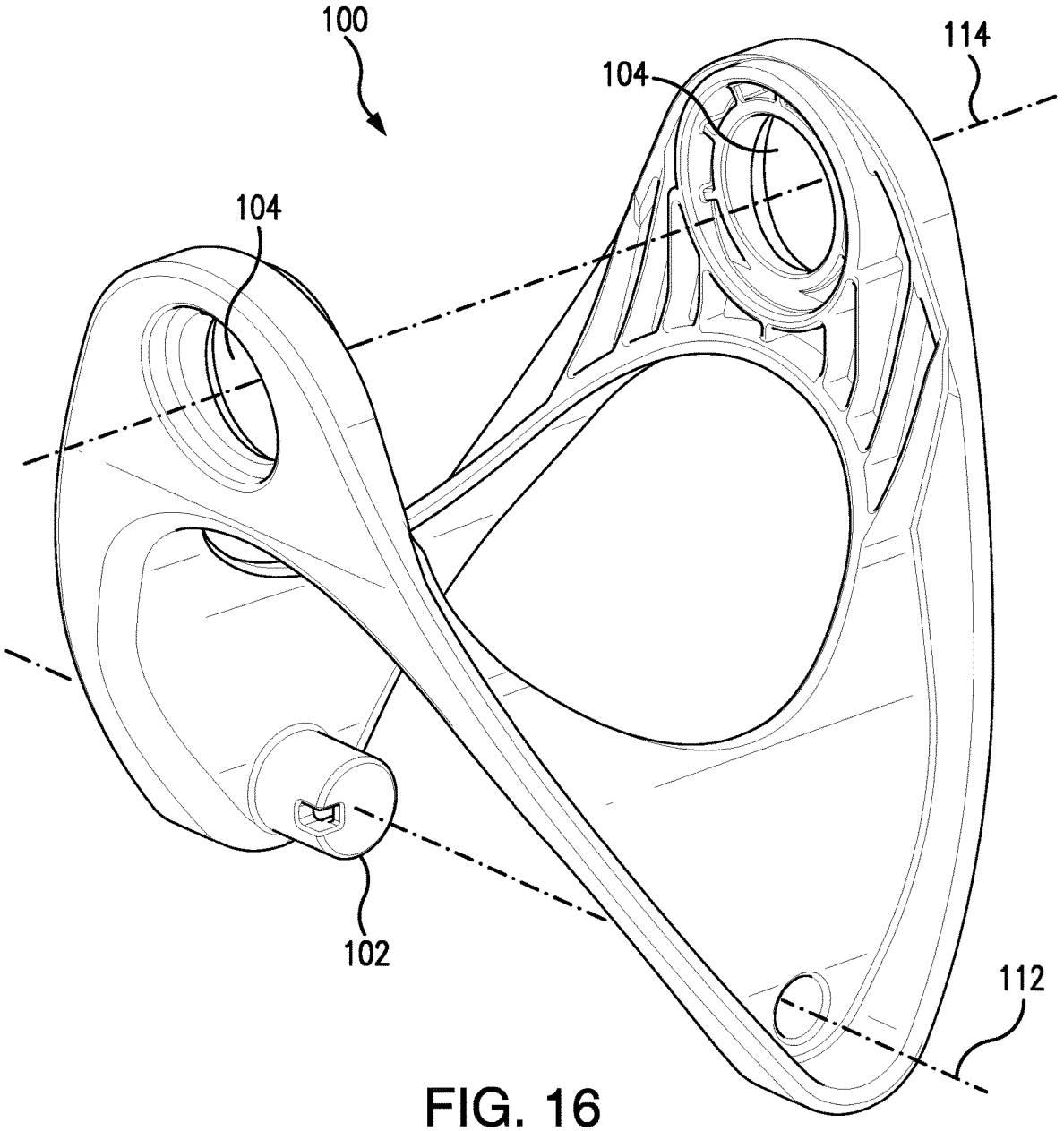
FIG. 16 shows an isometric view of a hinge of the cleaning device shown in FIG. 1.

FIG. 16 further illustrates the hinge 100 according to an exemplary embodiment of the present invention. The hinge 100 includes at least one rotatable connector 102 on a lower end of the hinge 100 defining a first axis 112 and at least one connector 104 on a top end of the hinge 100 defining a second axis 114. In the exemplary embodiment, the hinge 100 has two connectors 102 in the form of opposing protrusions on the lower end of the hinge 100 and two connectors 104 in the form of opposing receptacles (or protrusions) on the top end of the hinge 100. The connectors 102/104 mate with corresponding receptacles or connectors on the base 10 (see, e.g., receptacles 103 in FIG. 23) and the vacuum body 8 or shaft 7.

Figure 17:
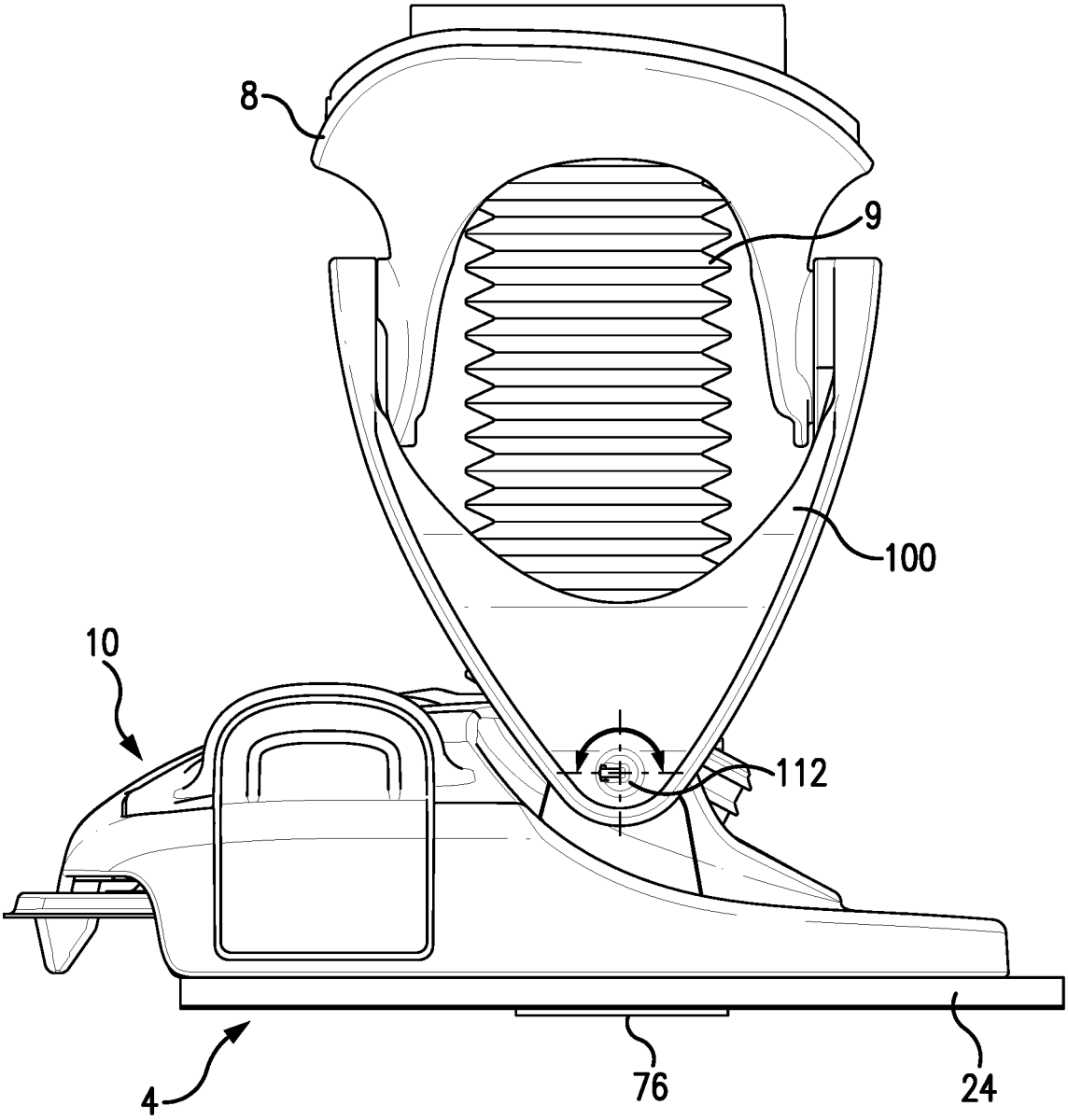
FIG. 17 shows a partial side view of the cleaning device shown in FIG. 1 with the handle of the cleaning device in an upright position.
Figure 18:
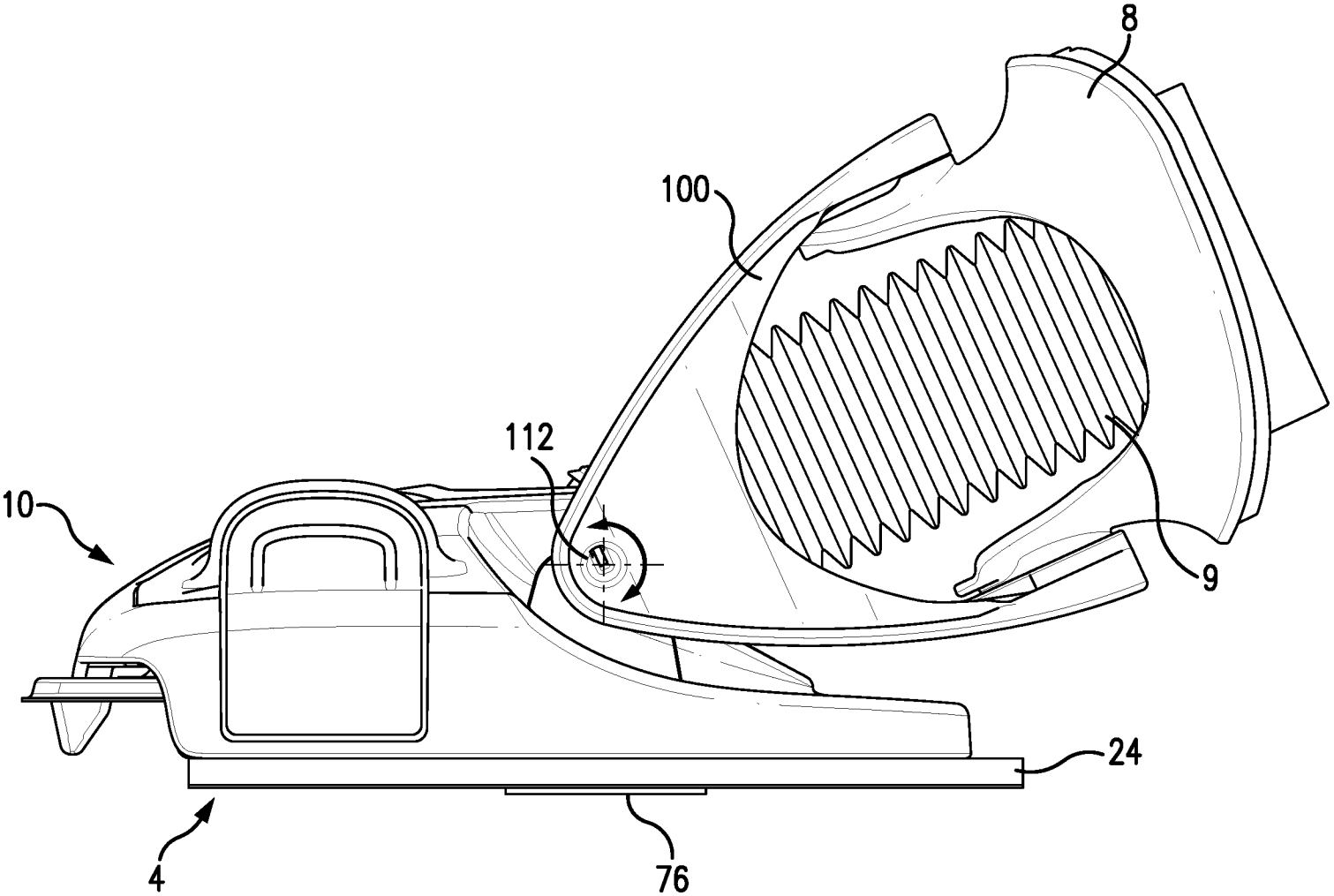
FIG. 18 shows a partial side view of the cleaning device shown in FIG. 1 with the handle of the cleaning device rotated in an aft position.
Figure 19:
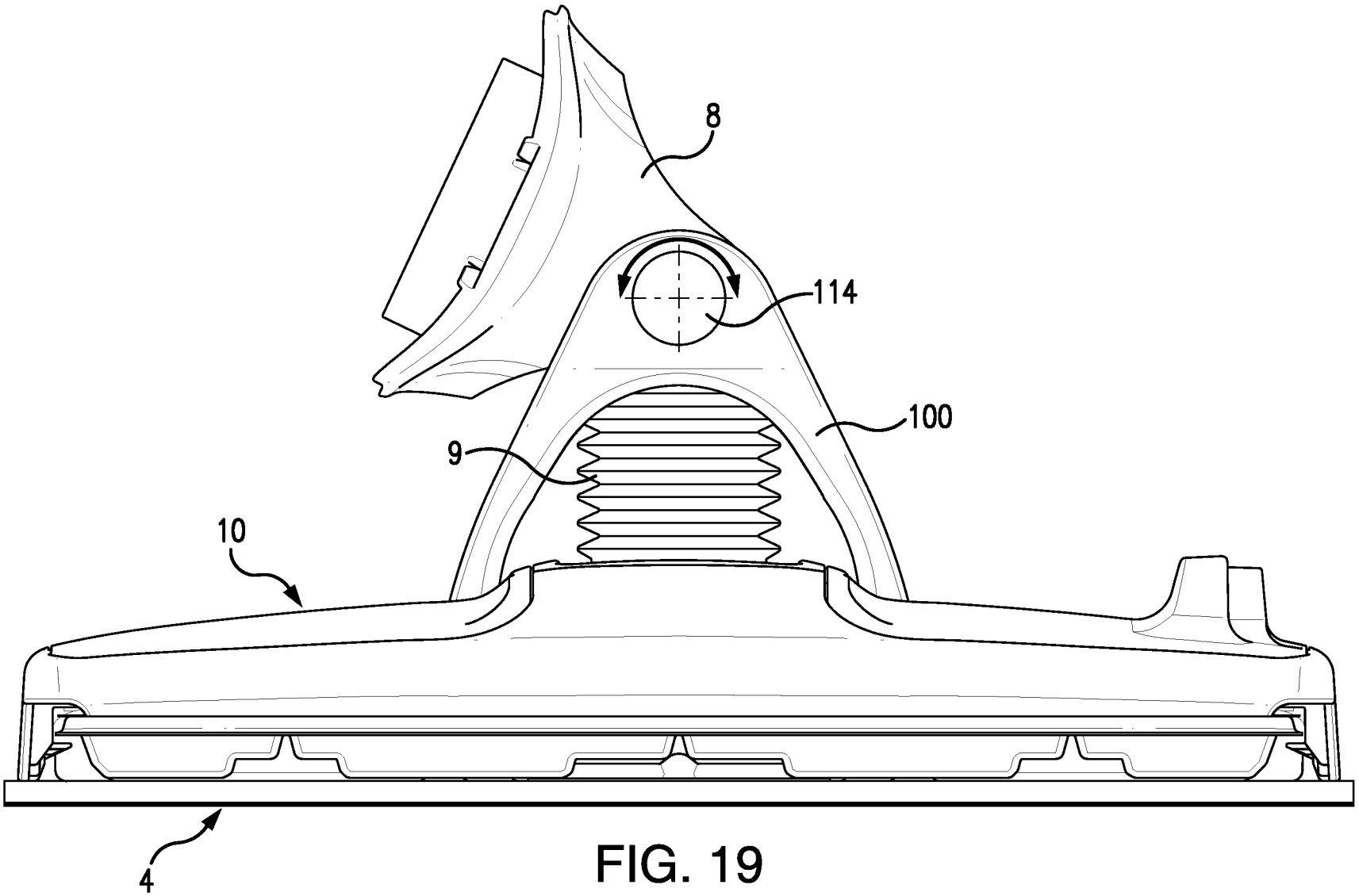
FIG. 19 shows partial front view of the cleaning device shown in FIG. 1 with the handle of the cleaning device rotated to one side.
Figure 20:
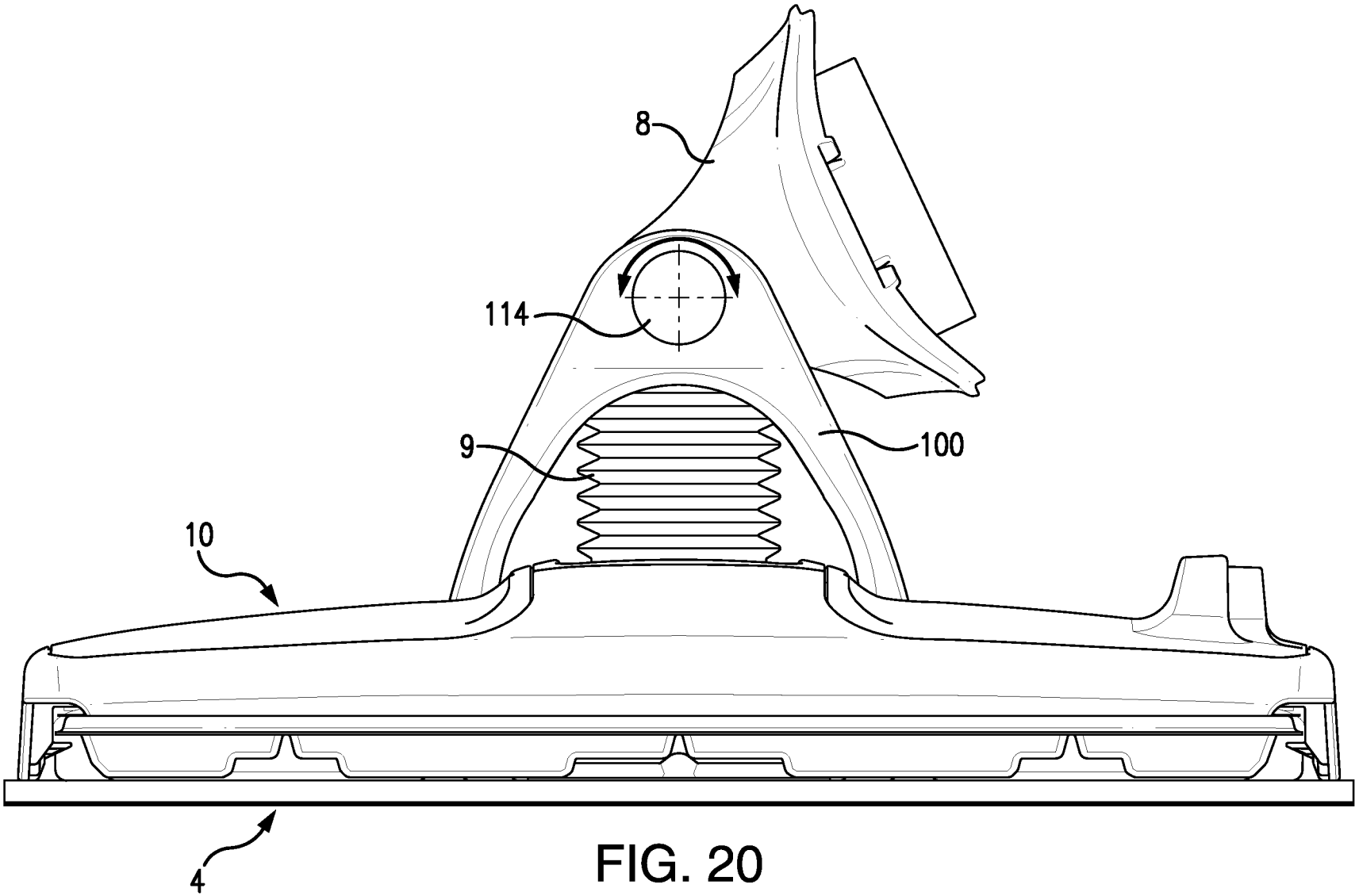
FIG. 20 shows partial front view of the cleaning device shown in FIG. 1 with the handle of the cleaning device rotated to the other side.

FIGS. 17 and 18 show side views of the cleaning device 2 and particularly the interaction between the hinge 100 and the base 10 about the lower pivot axis 112. The handle assembly of the cleaning device 2 is operable between an upright position as shown in FIG. 17 and a rearward position as shown in FIG. 18. FIGS. 19 and 20 show front views of the cleaning device 2 and particularly the interaction between the hinge 100 and the vacuum body 8 of the handle assembly of the cleaning device 2 about the upper pivot axis 114. The handle assembly of the cleaning device 2 is operable between left side position (from the user's perspective) as shown in FIG. 19 and a right side position (from the user's perspective) as shown in FIG. 20.

The pivot axes of the hinge 100 are positioned to ensure maximum effectiveness of the cleaning device 2. In particular, it is desired to maintain contact between the pad 24 and the floor with no or minimal lifting up or skipping during movement across the floor. Further, it is desired to ensure that sufficient force is directed against the centrally located scrubbing strip 76 for maximum scrubbing and that the opening 52 substantially remains in close proximity to the floor.

Figure 21:
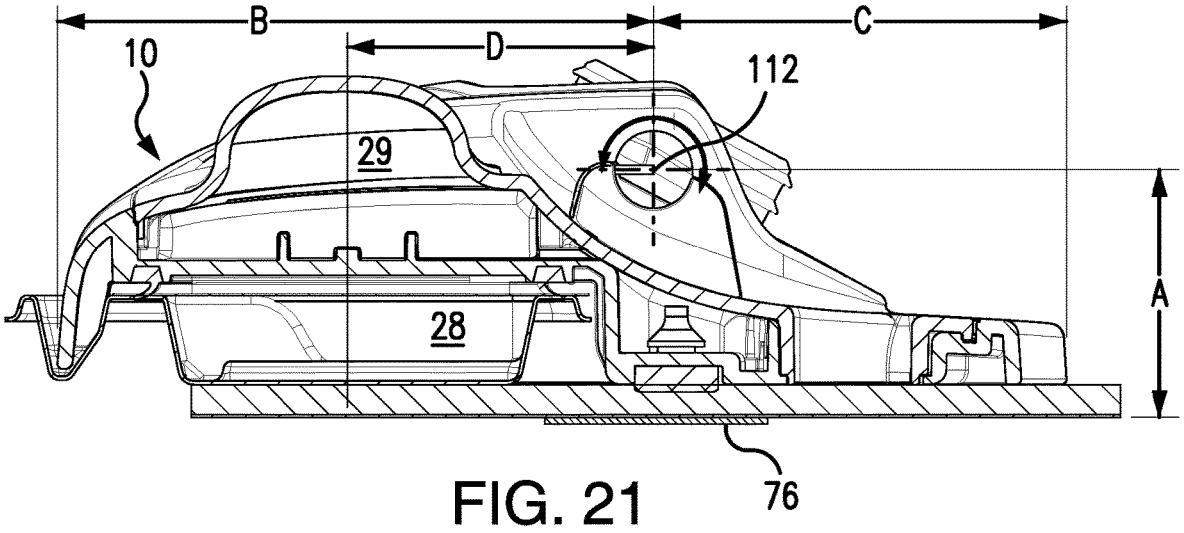
FIG. 21 shows a cross-sectional view of the base of the cleaning device shown in FIG. 1 taken down the center of the base.

FIG. 21 is a cross-sectional view of the base 10 showing the position of the lower pivot axis 112 including relative dimensions between the lower pivot axis 112 and the rest of the base 10 and the replacement head 4. The lower pivot axis 112 has a height A above the bottom of the pad 24 of the replacement head 4, a distance B from the front edge of the base 10, a distance C from the back edge of the base 10, and a distance D from the center of the dust chamber 28 and a vacuum chamber 29 above the dust chamber 28.

The dimensions may be adjusted and/or scaled up or down for different applications. However, in the exemplary embodiment, the lower pivot axis 112 is between zero (0) mm and 60 mm above the lower surface of the replacement head 4 and pad 24 (see dimension A). Preferably, A is less than half of B+C. Higher positions could lead to skipping of the base 10 during use or tipping of the base 10 fore or aft.

In some embodiments, the lower pivot axis 112 is between 20 mm and 50 mm above the bottom of the pad 24. In a preferred embodiment, the lower pivot axis 112 is between 30 mm and 40 mm above the bottom of the pad 24, such as 35 mm. Further, the base 10 has a width (front to back, dimension B+C) of approximately 85-185 mm, preferably 110-160 mm, and more preferably about 135 mm. In some embodiments, the first pivot axis 112 is centered in the width of base 10 such that B=C, approximately. In some embodiments, the first axis 112 is plus or minus 30 mm of center, plus or minus 20 mm, or preferably plus or minus 10 mm. In one exemplary embodiment, B is equal to about 75 mm, C is equal to about 60 mm, and D is equal to about 40 mm.

Figure 22:
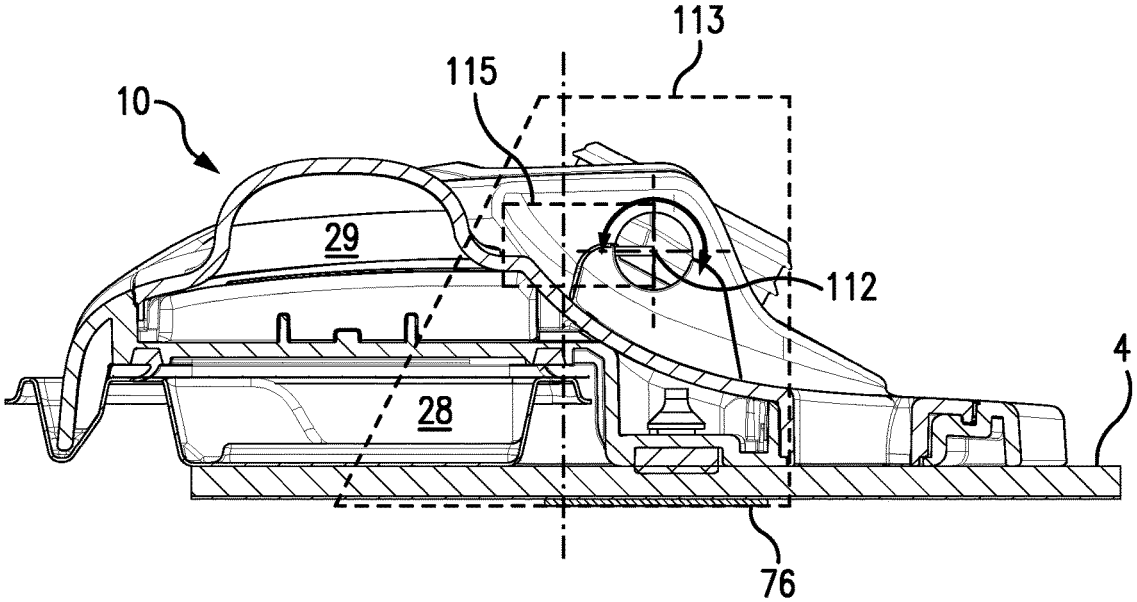
FIG. 22 shows another cross-sectional view of the base of the cleaning device shown in FIG. 1 taken down the center of the base.

FIG. 22 is another cross-sectional view of the base 10 showing the position of the lower pivot axis 112 including exemplary areas, defined in a front to back cross-section of the base 10, in which the lower pivot axis 112 can be placed for effectiveness. Area 113 illustrates a trapezoidal area having a front to back maximum variation (from a center point of the base 10) of approximately 20-25% of the front to back width of the base 10, such as plus or minus 30 mm, and a maximum height of approximately 50% of the width of the base 10, such as 60 mm. As shown by the area 113, it may be advantageous to move the lower pivot axis 112 rearward as the height of the lower pivot axis 112 increases. As such, the exemplary area 113 is bound on the lower end by a first point about 30 mm forward of the center point of the base 10 and a second point about 30 mm rearward of the center point of the base 10. The exemplary area 113 is bound on the upper end, about 60 mm above the lower surface of replacement head 4, by a third point about 30 mm rearward of the center point of the base 10 and a fourth point approximately at the center point of the base 10. In some embodiments, the fourth point may be further back, such as 40 mm rearward of the center point.

A preferred area 115 for the lower pivot axis 112 is also shown which is bound on the lower end approximately 30 mm above the lower surface of the replacement head 4 between about 10 mm forward of the center point of the base 10 and about 10 mm rearward of the center point. The preferred area 115 is bound on the upper end approximately 40 mm above the lower surface of the replacement head 4 between about 10 mm forward of the center point of the base 10 and about 10 to 15 mm rearward of the center point. In some embodiments, the lower rear bound may be 15-20 mm rearward of the center point.

Figure 23:
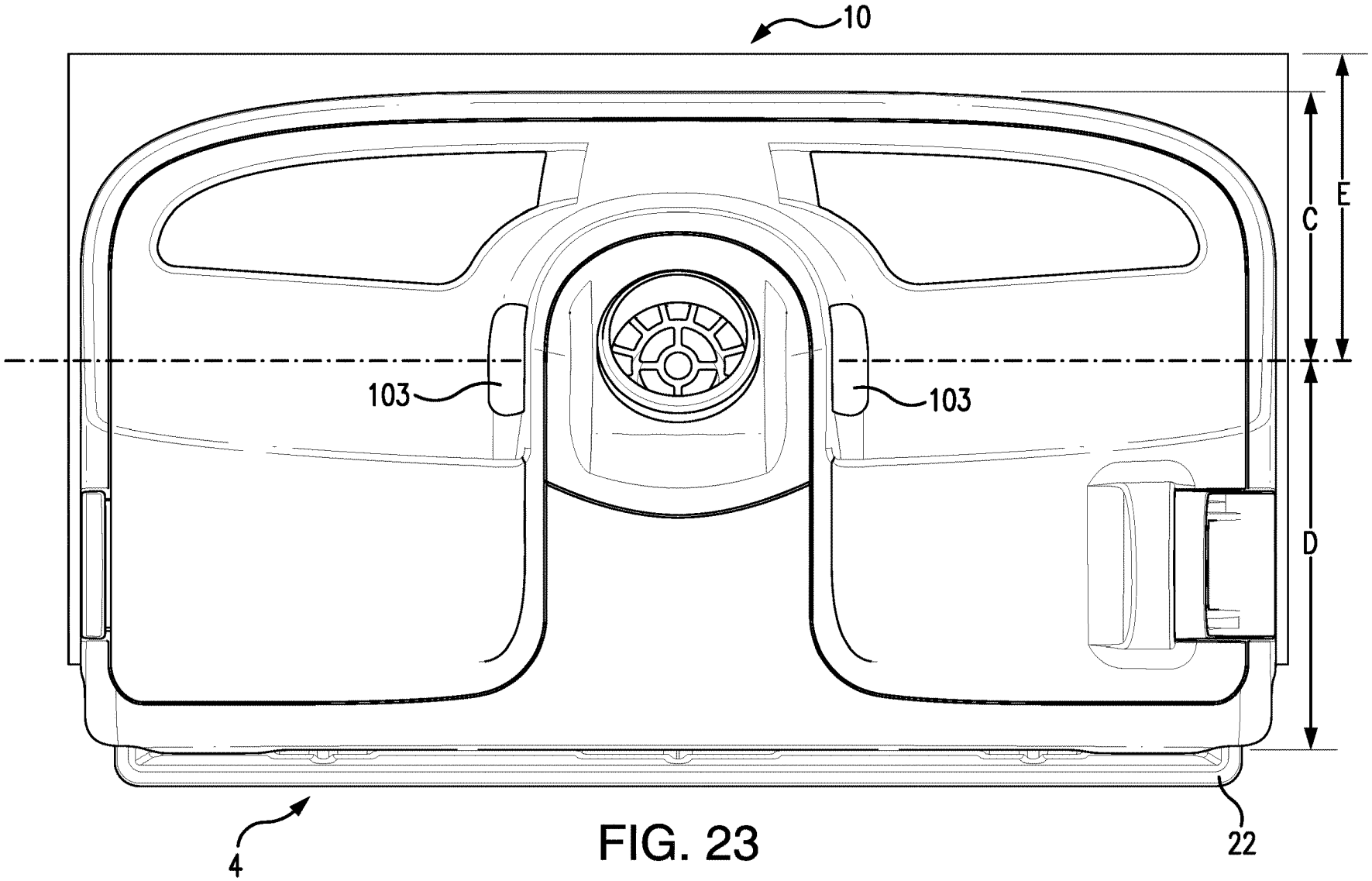
FIG. 23 shows a top view of the base of the cleaning device shown in FIG. 1.
Figure 24:
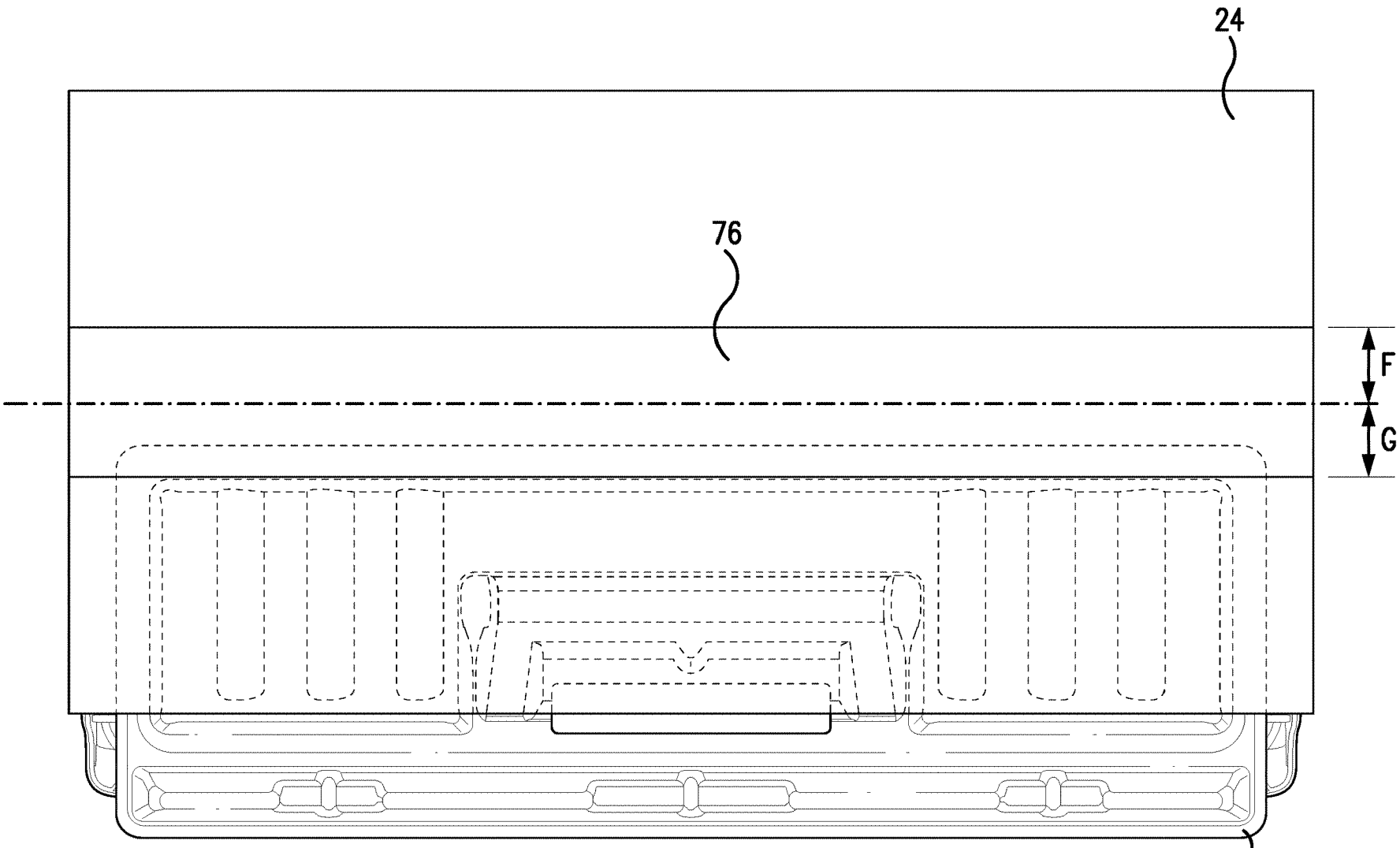
FIG. 24 shows a bottom view of the base of the cleaning device shown in FIG. 1.

FIGS. 23-24 show top and bottom views, respectively, of the base 10 including the replacement head 4. As shown, the lower pivot axis 112 is a distance E from a back edge of the replacement head 4/pad 24. In the exemplary embodiment, the distance E is 40-80 mm, such as approximately 63-65 mm. The lower pivot axis 112 is also a distance F from a back edge of the scrubbing strip 76 and a distance G from a front edge of the scrubbing strip 76. In the exemplary embodiment, distance F is approximately equal to distance G such that the lower pivot axis 112 is centered above the scrubbing strip 76.

The position of the upper pivot axis 114 is in a perpendicular plane to the lower pivot axis 112 at a distance dictated by the dimensions of the hinge 100. For example, the upper pivot axis 114 may be 40-120 mm away from the lower pivot axis 112, preferably 60-100 mm, such as approximately 80 mm. In the exemplary embodiment, the upper pivot axis 114 is at a height above the lower surface of the replacement head 4 equal to or less than the width of the base 10 and/or equal to or less than the length of the base 10 when the handle assembly is in the upright position. As the handle assembly is rotated, the upper pivot axis 114 rotates and moves closer to the lower surface of the replacement head 4.

Although the invention has been described with reference to a particular arrangement of parts, features and the like, these are not intended to exhaust all possible arrangements or features, and indeed many modifications and variations will be ascertainable to those of skill in the art.

What is claimed is:

1. A cleaning device, comprising:

a handle assembly including a proximal end and a distal end;

a base having a front edge and a rear edge defining a width;

a hinge rotatably attaching the distal end of said handle assembly to said base;

said cleaning device defining a first axis between said hinge and said base;

a replacement head removably attachable to said base, said replacement head including a suction inlet and a pad defining a lower surface of said cleaning device; and wherein the first axis is at a height above the lower surface, the height being less than half of the width.

2. The cleaning device of claim 1, wherein said handle assembly is pivotable about the first axis in fore and aft directions with respect to said base, and said handle assembly is pivotable in left and right directions about a second axis between said hinge and the distal end of said handle assembly.

3. The cleaning device of claim 1, wherein the first axis is between 30 mm and 40 mm above the lower surface.

4. The cleaning device of claim 1, wherein the first axis is rearward of the suction inlet.

5. The cleaning device of claim 1, wherein the first axis is positioned between a first vertical plane defined by the front edge of said base and a second vertical plane defined by the rear edge of said base.

6. The cleaning device of claim 5, wherein the first axis is positioned relative to a midpoint between the first vertical plane and the second vertical plane, wherein the first axis is between 30 mm forward of the midpoint and 30 mm rearward of the midpoint.

7. The cleaning device of claim 6, wherein the first axis is between 20 mm forward of the midpoint and 20 mm rearward of the midpoint.

8. The cleaning device of claim 6, wherein the first axis is between 10 mm forward of the midpoint and 10 mm rearward of the midpoint.

9. The cleaning device of claim 8, wherein the first axis is between 30 mm and 40 mm above the lower surface.

10. The cleaning device of claim 1, wherein the pad includes a first layer and a second layer, the second layer being a strip having a width from a front edge of the strip to a rear edge of the strip that is less than a width of the first layer.

11. The cleaning device of claim 1, wherein said replacement head includes a plastic tray attached to the pad, the plastic tray including a dust chamber including a top at least partially bounded by a filter, a bottom wall, a front wall, a rear wall, a left wall, and a right wall, and an opening that extends through at least one of the walls into the dust chamber.

12. The cleaning device of claim 11, wherein the height of the first axis above the lower surface is greater than a height of a top of the dust chamber above the lower surface.

13. The cleaning device of claim 1, wherein said handle assembly includes a vacuum body defining the distal end.

14. A cleaning device, comprising:

a handle assembly including a proximal end and a distal end;

a base having a front edge and a rear edge defining a width;

a hinge rotatably attaching the distal end of said handle assembly to said base;

said cleaning device defining a first axis between said hinge and said base;

a replacement head removably attachable to said base, said replacement head including a suction inlet and a pad defining a lower surface of said cleaning device;

wherein the pad includes a first layer and a second layer, the second layer being a strip having a width from a front edge of the strip to a rear edge of the strip that is less than a width of the first layer;

wherein the first axis is positioned between a first vertical plane defined by the front edge of the strip and a second vertical plane defined by the rear edge of the strip.

15. The cleaning device of claim 10, wherein the first axis is between 30 mm and 40 mm above the lower surface.

16. The cleaning device of claim 14, wherein said replacement head further includes a dust chamber, wherein the first axis is at a first height above the lower surface, wherein a top of the dust chamber is at a second height above the lower surface, the first height being greater than the second height.

17. The cleaning device of claim 16, wherein first axis is rearward of the dust chamber.

18. The cleaning device of claim 14, wherein said handle assembly is pivotable about the first axis in fore and aft directions with respect to said base, and said handle assembly is pivotable in left and right directions about a second axis between said hinge and the distal end of said handle assembly.

19. A cleaning device, comprising:

a handle assembly including a proximal end and a distal end;

a base having a front edge and a rear edge defining a width;

a hinge between the distal end of said handle assembly and said base;

said cleaning device defining a first axis between said hinge and said base;

a replacement head removably attachable to said base, said replacement head including a dust chamber and a pad, the pad defining a lower surface of said cleaning device; and wherein the first axis is perpendicular to a cross-sectional plane extending centrally through the width of said base, the first axis positioned within an area on the plane above the lower surface of said cleaning device and between a first point located on the lower surface at least one-fourth of a distance from the front edge to the rear edge and a second point located on the lower surface up to three-fourths of the distance from the front edge to the rear edge;

wherein the first axis is at a first height above the lower surface, wherein a top of the dust chamber is at a second height above the lower surface, the first height being greater than the second height.

20. The cleaning device of claim 19, wherein the first axis is below a third point 60 mm above the lower surface of said cleaning device.

21. The cleaning device of claim 19, wherein the first point is located at least 40% of the distance from the front edge to the rear edge.

22. The cleaning device of claim 21, wherein the second point is located up to 60% of the distance from the front edge to the rear edge.

23. The cleaning device of claim 19, wherein said handle assembly includes a vacuum body including a suction source.

24. A cleaning device, comprising:

a handle assembly including a proximal end and a distal end;

a base having a front edge and a rear edge defining a width;

a hinge between the distal end of said handle assembly and said base;

said cleaning device defining a first axis between said hinge and said base;

a replacement head removably attachable to said base, said replacement head including a pad defining a lower surface of said cleaning device; and wherein the first axis is perpendicular to a cross-sectional plane extending centrally through the width of said base, the first axis positioned within an area on the plane above the lower surface of said cleaning device and between a first point located on the lower surface at least one-fourth of a distance from the front edge to the rear edge and a second point located on the lower surface up to three-fourths of the distance from the front edge to the rear edge;

wherein the area is a trapezoid defined by the first point, the second point, a third point a height above the lower surface and about 50% of the distance from the front edge to the rear edge, and fourth point the height above the lower surface and about 75% of the distance from the front edge to the rear edge.

25. The cleaning device of claim 24, wherein the height is equal to a distance less than 45% of the width.

* * * * *